US006871643B2

(12) United States Patent
Cooper et al.

(10) Patent No.: US 6,871,643 B2
(45) Date of Patent: Mar. 29, 2005

(54) ECCENTRIC ELEMENTS FOR A COMPOUND ARCHERY BOW

(75) Inventors: Darin B. Cooper, Layton, UT (US); Jason L. Fogg, Tooele, UT (US)

(73) Assignee: Hoyt USA, Inc., SLC, UT (US)

( * ) Notice: Subject to any disclaimer, the term of this patent is extended or adjusted under 35 U.S.C. 154(b) by 52 days.

(21) Appl. No.: 10/273,911

(22) Filed: Oct. 18, 2002

(65) Prior Publication Data

US 2004/0074485 A1 Apr. 22, 2004

(51) Int. Cl.[7] ..... F41B 41/00
(52) U.S. Cl. ..... 124/25.6; 124/900
(58) Field of Search ..... 124/23.1, 25.6, 124/80, 86, 90, 91, 900

(56) References Cited

U.S. PATENT DOCUMENTS

| | | | | |
|---|---|---|---|---|
| 3,486,495 A | | 12/1969 | Allen | |
| 4,365,611 A | | 12/1982 | Nishioka | 124/24 R |
| 4,686,955 A | * | 8/1987 | Larson | 124/25.6 |
| 4,774,927 A | | 10/1988 | Larson | |
| 4,957,094 A | | 9/1990 | Pickering et al. | 124/24.1 |
| 4,967,721 A | * | 11/1990 | Larson | 124/25.6 |
| 5,146,908 A | * | 9/1992 | Larson | 124/88 |
| 5,368,006 A | | 11/1994 | McPherson | 124/25.6 |
| 5,433,792 A | | 7/1995 | Darlington | 124/25.6 |
| 5,505,185 A | | 4/1996 | Miller | |
| 5,678,529 A | * | 10/1997 | Larson | 124/25.6 |
| 5,791,322 A | | 8/1998 | McPherson | 124/25.6 |
| 5,890,480 A | | 4/1999 | McPherson | 124/25.6 |
| 5,960,778 A | * | 10/1999 | Larson | 124/25.6 |
| 5,975,067 A | | 11/1999 | Strother | 124/25.6 |
| 6,082,347 A | | 7/2000 | Darlington | 124/25.6 |
| 6,112,732 A | * | 9/2000 | Larson | 124/25.6 |
| RE37,544 E | | 2/2002 | Darlington | 124/25.6 |
| 6,415,780 B1 | * | 7/2002 | Proctor | 124/25.6 |
| 6,443,139 B1 | | 9/2002 | McPherson | 124/25.6 |
| 2003/0136392 A1 | * | 7/2003 | McPherson | 124/25.6 |

OTHER PUBLICATIONS

Larry D. Miller Patent Application filed Jan. 19, 1981 (Serial No. 225,825).
Larry D. Miller CIP Patent Application filed Oct. 18, 1982 (U.S. Appl. No. 06/434,999).

* cited by examiner

*Primary Examiner*—Kien Nguyen
(74) *Attorney, Agent, or Firm*—Holland & Hart

(57) ABSTRACT

A pulley arrangement for a compound archery bow (100) that combines the forgiveness and symmetry of a "dual cam" system with the positive draw stop (hard wall), enforced synchronization (or built-in timing) between opposite pulley assemblies, and high let-off associated with "single cam" systems. The pulley rigging (112) includes only a single cable reference anchor to a limb (104, 106). Certain pulleys (108, 110) include rotating module portions (183, 214) effective to change the wrapped lengths of power and control cables (270, 272) to change draw length ($L_D$) while the bow (100) is strung, and at a brace condition with the drawstring (116) under full tension, and without changing the timing of the pulley members (108, 110), or changing the lengths of rigging members (112). Certain embodiments include a resilient element (196) in a positive draw stop (194) to reduce noise as the draw stop (194) engages a rigging element (270). A resilient element (206) adapted to reduce drawstring vibration may further be included, in one or more pulleys, and arranged to contact the drawstring (116) as the pulleys (108, 100) over-rotate. A preferred mounting arrangement employs a flanged bearing assembly (200) to resist bearing walk relative to the pulley on which the bearing assembly (200) is installed. Certain preferred embodiments of pulleys (108, 110) include a spiral cam shape at a let-off portion of the string cams (150, 210).

47 Claims, 9 Drawing Sheets

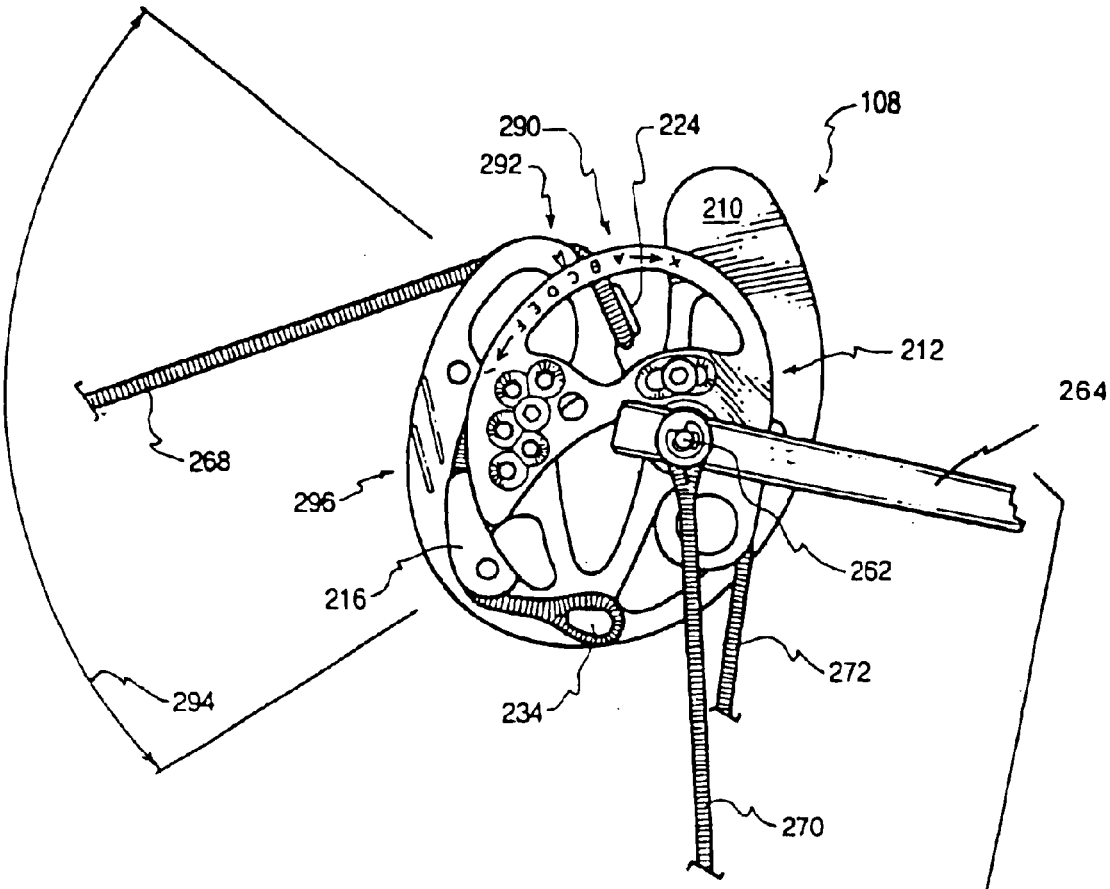
Fig.10
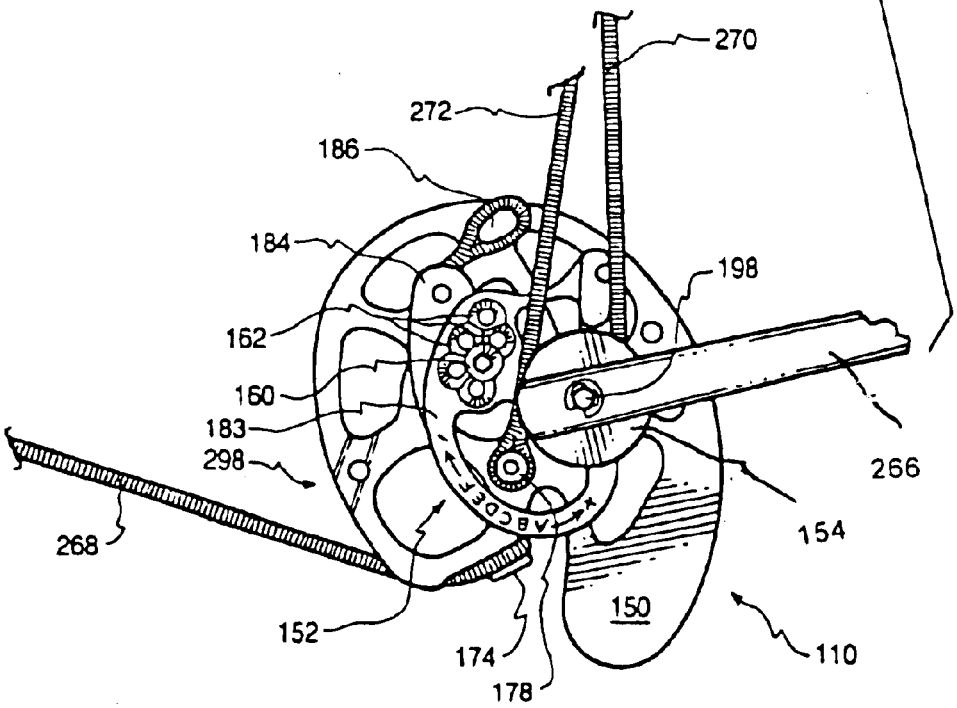

ECCENTRIC ELEMENTS FOR A COMPOUND ARCHERY BOW

BACKGROUND

1. Field of the Invention

The present invention relates to compound archery bows, and particularly to eccentrics operable with such bows.

2. State of the Art

Compound archery bows employ a pulley system with bow string rigging arranged to provide a mechanical advantage to deflect flexible bow limbs, and to provide a draw force let-off at full draw. The limbs of a typical compound bow are much more stiff than limbs of a typical prior art single action bow, such as a recurve or long bow. Therefore, the limb deflection of a compound bow can be reduced while still storing sufficient energy to provide enhanced arrow speed compared to such prior art bows. The draw force let-off effected by the pulley arrangement permits an archer to hold an arrow at full draw with reduced exertion, likely resulting in more accurate shot placement than with a single action bow.

For purposes of this disclosure, brace, or a brace condition, is defined as the orientation achieved in a fully strung bow having tension applied to the drawstring solely by the bow limbs. That is, brace is defined as a static position of a bow that is ready to nock an arrow.

The term "pulley" encompasses a single wheel or eccentric element, but also includes an assembly of one or more such components. In the latter case, the term "pulley assembly" is sometimes used. The components that make up a pulley, or pulley assembly, are primarily wheels, or eccentrics. In an archery context, a wheel typically defines a groove, or string track, in which to receive a bow string rigging element, that is concentric with an axis of rotation of the wheel. An eccentric defines a groove, or string track, in which to receive a rigging element, that is spaced by a variable radius from the axis of rotation of the eccentric. Sometimes, an eccentric or wheel may be identified as a "cam" substantially in accordance with its ordinary dictionary meaning. However, in certain cases, principally for marketing language, a bow may be referred to in terms of selected characteristics of its pulley members. In marketing lingo, a pulley, or pulley assembly, may sometimes be referred to as a "cam".

Bow string rigging for a compound archery bow is to be understood to encompass one or more two-force members that can be arranged to cause pulley rotation during a draw motion. One two-force member is adapted to serve as a drawstring. The drawstring may be a central, or intermediate, stretch of a longer string, or cable, that is entrained about one or more pulleys with ends of the cable being anchored to structure. End stretches of string rigging are typically referred to as cables, regardless of their actual construction. Modern practice typically provides drawstrings made from a multistrand, synthetic material, and end stretches made from other material, including aircraft cable, although any workable arrangement, or combination of materials is acceptable for practice of the invention. A stretch of cable having an end anchored to a limb, or other nonrotating structure, is typically classified as a power cable. A stretch of cable anchored between pulleys is sometimes called a control cable, although a drawstring may be similarly anchored. A stretch of cable may be regarded as a rigging element.

Early compound archery bows, such as disclosed in U.S. Pat. No. 3,486,495 to Allen, employed a pair of pulleys located for eccentric rotation disposed at tip ends of opposite bow limbs. Bow string rigging was entrained about the pulleys such that an end of a rigging element was anchored to each opposite bow limb. Such an anchor arrangement effectively provides two cable reference anchors to the bow. Maintaining timing of the two pulleys with respect to each other in such a string rigging arrangement is critical to achieving stable arrow flight. As the pulleys lose rotational synchronization with each other, the nocking point inherently departs from a straight-line path between full draw and a brace condition. Such nonlinear nocking point travel can cause erratic arrow flight, and loss of accuracy. It is common for a bow carrying such rigging to "go out of time", due to any number of factors, such as cable stretch, or pulley slipping relative to the cable rigging. Archery bows having such rigging may be classified as "dual cam" bows for marketing purposes.

Several approaches have been proposed to overcome the timing problem associated with typical "dual cam" bows. Among more recent such attempts is an improved pulley system, often referred to as a "single cam" arrangement. McPherson, in U.S. Pat. No. 5,368,006 discloses a bow exemplifying such a configuration. The improved pulley arrangement places an eccentric cam element at only one limb end, and a cooperating idler cam element at the opposite limb end. Such an idler cam is concentric about its mounting axle, so the idler cam cannot effect timing of the opposite pulley. A single cable reference anchor is provided at the limb end carrying the idler. Synchronization between the pair of pulleys mounted on the bow is inherent due to the single eccentric element. Bows of this type may be regarded as true "single cam" bows. However, such true "single cam" bows also inherently force a transverse component in nocking point travel between full draw and brace. The eccentric cam element of one pulley unavoidably unwraps drawstring at a variable rate while the idler cam component of the opposite pulley unwraps drawstring at a constant rate. Therefore, the transverse nocking point travel is nonlinear between full draw and a brace condition in such a "single cam" bow. Such behavior is also evident in certain modified forms of the "single cam" assembly, especially if one, or both, pulleys included in the rigging is/are adjustable to change draw length of the bow.

It can be difficult to set up, or tune, a bow to provide consistent, straight arrow flight. As a first step, the timing between pulley assemblies may need to be adjusted to synchronize pulley rotation. Further adjustments may be required to the nocking point location on the drawstring, and to both lateral and vertical position of the arrow rest, to minimize wobble of an arrow in flight. Once a bow is set up, it can be frustrating if the pulley timing changes, as frequently occurs over time in certain known archery bows. Making an adjustment to the bow, such as changing the draw length, often compromises the tune of the bow by changing the timing between the pulley members. In the case of certain "one cam" bows, a change in draw length inherently causes an undesirable change in the nocking point travel path. A major problem with certain prior art bows is simply keeping rotation of the pulleys synchronized, while permitting a simple, easy adjustment in certain bow characteristics, such as draw length. One attempt to address this problem is disclosed by Larson in U.S. Pat. No. 4,774,927. Larson discloses a pulley having a rotatable cam portion, or module, operable to change a draw length of a bow on which the pulley is mounted.

Considerable effort has been devoted to developing pulley shapes to preserve a draw weight let-off while maximizing stored energy in a bow's limbs. Pulley shapes encompass the various string and cable grooves-carried on the individual cam elements forming the pulley assemblies. Miller, in U.S. Pat. No. 5,505,185, discloses certain desirable component elements of a pulley assembly, including a power cam element. It would be desirable further to provide an improved profile for pulley elements operable to better harness the stored limb energy for stable transfer of that energy to an arrow to increase certain shooting characteristics of a bow, such as arrow velocity.

End stretches of cables are often anchored to post-type structure carried on a pulley of bow string rigging, or on a component forming such a pulley. Commonly, a relatively short, stubby, post-type anchor is affixed to a cam component for anchoring a cable of an immediately adjacent cam component. In certain cases, an anchor may have a desired foundation location spaced apart, by one or more cam components, from a plane in which the anchored cable acts to apply loads to the anchor. Such circumstances require a tower anchor, which increases the moment arm by which cable loads are amplified with respect to the foundation. Often, cable loads on the anchor structure reach a peak value as an arrow is fired, and the brace cable load, plus an additional impact load, is resisted by the anchor. In some cases, the anchor desirably is arranged to be removable from its foundation, e.g. to replace or to install certain pulley components. In such cases, cable loads may cause failure of the foundation, or of the fastening arrangement used to affix the tower anchor to the foundation.

Prior art bows, in general, often display certain undesirable traits. One such trait is the undesirable "click" produced by rotation of a positive draw stop into interference with a rigging member. Such a click can alert a hunter's quarry to the hunter's presence. One commercially available solution adhesively affixes a dampener pad to a contacting surface of a cam-mounted draw stop surface. Such dampener pad is prone to loss by being scraped from the draw stop surface, or by loss of adhesion between the draw stop surface and the dampener pad.

Excessive vibration subsequent to release of an arrow is another undesirable trait of certain bows. In certain instances, pulleys having press-fit bearing assemblies "walk" or move transversely with respect to their bearing assemblies due to vibration and side load applied from bow string rigging. Sometimes, such pulleys displace or transversely "walk" sufficiently with respect to their mounting bearing that the pulley detrimentally rubs, or scrapes, on spacers or other structure associated with the pulley mounting area. It would be an improvement to provide bow rigging elements operable to address the deficiencies found in prior art archery bows.

BRIEF SUMMARY OF THE INVENTION

The present invention provides an asymmetrical cam system for use in rigging the drawstring and limb-flexing cables for a compound archery bow. Pulley assemblies according to the invention are structured to provide certain beneficial aspects over the prior art "single cam" and "dual cam" systems, while also avoiding certain of their negative aspects. A notable benefit of the asymmetrical cam system of the present invention is their ability to combine the forgiveness and symmetry of a "dual cam" system with the positive draw stop (hard wall), enforced synchronization (or built-in timing) between opposite pulley assemblies, and high let-off associated with "single cam" systems. According to some embodiments, the asymmetrical cam system accommodates a change in draw length of the bow without requiring the use of a bow press. Furthermore, in certain embodiments of pulleys providing adjustable draw length, changing the draw length does not cause a change in either nocking point travel, or the shape of the draw force curve between brace condition and peak draw weight.

A representative bow incorporating the asymmetrical cam system of the present invention typically includes: a handle, or riser, with a top limb and a bottom limb attached to the riser, with the top and bottom limbs extending from the riser to respective top and bottom limb ends. A first pulley is attached for rotation at the end of one limb tip; a second pulley is attached for rotation at the end of the other limb tip. Bow string rigging is entrained about the first and second pulleys, such that the rigging has only a single cable reference anchor to a limb. Also, the first and second pulleys desirably are structured and arranged in harmony with the rigging such that a change in draw length may be accomplished while the bow is strung and at brace condition with a drawstring under full tension from the top and bottom limbs.

Pulleys according to the invention may include rotatable modules configured and arranged to permit a change in draw length without causing a corresponding change in transverse nocking point travel, or otherwise negatively effecting the tune of the bow. Certain pulleys alternatively provide only fixed modules adapted to provide a certain, fixed, draw length. Such nonadjustable pulleys may be employed on a custom basis, to further improve bow performance by reducing pulley mass and rotational inertia. Alternatively, draw length may be adjusted in certain embodiments by replacement of an entire module or cam, or of a portion of a module or cam. Modules, or cams, specifically are not required to rotate with respect to a foundation to accomplish an adjustment in draw length. Other relative motions are within contemplation to effect an adjustment of a module or cam, including shifting, translating, and sliding.

Bow string rigging, of bows according to the invention, typically includes a power cable anchored at a first end to the reference limb anchor, and anchored at a second end to the second pulley for wrapping onto a portion of the second pulley during a draw motion. The rigging further includes a control cable anchored at a first end to an anchor carried on the second pulley and adapted to unwrap from a portion of the second pulley during the draw motion, and anchored at a second end to an anchor carried on the first pulley for wrapping onto a portion of the first pulley during the draw motion. The drawstring is typically anchored at a first end to the first pulley and anchored at a second end to the second pulley, and is arranged to unwrap from each of the first and second pulleys during the draw motion.

It is desirable for pulleys to be configured and arranged to permit a change in draw length without causing a change in the draw force curve in the portion of the curve between brace and up to full bow weight. Certain preferred pulleys resist a change in peak draw weight over the range of draw length adjustment provided by those pulleys. Furthermore, the pulleys typically are configured and arranged to permit making a change in draw length without requiring a change in length of the drawstring or cables of the rigging.

In detail, the first pulley can be classified as a follower pulley and includes a follower string cam. The follower string cam defines a follower string groove operable to wrap and unwrap a first end of the drawstring. In one embodiment, the follower string cam carries a first anchor for the drawstring and a second anchor for an end of a control cable. The follower pulley also includes a follower cam defining a follower control cable groove operable to space the control cable apart from the pulley axle by a variable radius.

The second pulley can be classified as a control pulley and includes a control string cam. The control string cam defines a control string groove operable to wrap and unwrap a second end of the drawstring for the archery bow. In one embodiment, the control string cam carries a first anchor for the drawstring, a second anchor for an end of a power cable, and a third anchor for an end of a control cable. The second pulley also includes a power cam defining a power cable groove operable to space the power cable away from the control pulley axle by a variable radius, and a timing cam. The timing cam defines a timing groove operable to space the control cable apart from the control pulley axle. Certain currently preferred timing cams are concentric about their mounting axis.

One end of the power cable is anchored in some fashion to a bow limb at the cable reference anchor. As previously mentioned, the other end of the power cable can be anchored to the control string cam element of the control pulley. The power cable provides a rotational reference for both of the first and second pulleys with respect to the bow. The single rotational reference prevents timing of the pulleys to vary as a torque is applied to a handle (e.g. by a heavy stabilizer having an extended length) during a draw motion. Rotation of the follower pulley is slaved to the control pulley by the control cable. Therefore, rotation of one pulley may only occur if the other pulley also rotates. Furthermore, the rotation of both pulleys is coordinated with respect to the bow by way of the cable reference anchor.

Certain cam elements forming the respective pulleys are shaped to cooperate with other cam elements. For example, it is generally desired for the operable (working or cable-contacting for wrapping and unwrapping) portion of the timing groove carried by the timing cam to be substantially concentric about the axle of the control pulley. The shape of the follower control cable groove is generally defined to provide an arc length substantially equivalent to an arc length required to wrap onto the follower cam, during a draw motion, a length of control cable equal to the sum of a length of control cable unwrapped from the timing cam during that draw motion, plus a length of power cable wrapped onto the power cam during that draw motion. The wrapped arc length of the follower control cable groove desirably accounts for arc length differences in wrapped and unwrapped power and control cable portions caused by tangency differences between the timing groove and the follower control cable groove relative to the power cable groove. In certain pulley embodiments providing draw length adjustment, portions of the power groove and the control groove may be concentric about a reference structure, such as their respective pivot axles.

Adjustment in draw length for certain embodiments of a bow constructed according to the invention may be accomplished by rotating a control power module with respect to the control string cam, and rotating a follower module with respect to the follower string cam by a corresponding amount. Such an adjustment in draw length can be accomplished without changing the timing of the pulleys with respect to each other, or to the bow. Indicia may be included on one or more pulley components to assist in making equivalent changes to each pulley. The modules preferably are fixed in place, with respect to their corresponding string cams, by one or more removable fasteners arranged as one or more pegs in receiving conduits through the respective module. In certain preferred embodiments of the invention, the draw length can be adjusted while the bow is fully strung and at brace, without requiring use of a bow press.

Once a bow constructed according to principles of the invention is set up, or placed "in tune", it should remain at least substantially "in tune", even as its draw length is changed. The arrangement of the rigging and rigging anchors produces a control pulley and a follower pulley that are in static equilibrium at brace. Rotation of the follower pulley is slaved to the control pulley by way of the control cable, which is anchored, or affixed at ends of its span to each pulley. The follower pulley cannot rotate without the control pulley rotating also, and vice versa. Elongation of one or more cable stretches is accommodated by rotation of the two pulleys in approximately equal proportion, thereby resisting a change in pulley timing. Use of a single cable reference anchor, and slaving rotation of the follower pulley to the control pulley, prevents a change in timing between the two pulleys due to either cable stretch or adjustment in draw length. Furthermore, in the event that the two opposed pulleys were mistimed with respect to each other, the operating behavior provided by the instant pulleys generally will produce acceptable nocking point travel and a tunable arrangement. Conversely, an out of time "dual cam" system generally produces erratic nocking point travel.

The invention provides such significant let-off from the arrangement of power and follower cams, and associated power and control cables, that improvements may be made to string cam shapes to additionally improve shooting characteristics of a bow. It is now possible to incorporate a true spiral shape in a significant arc length portion of the perimeter of a string cam. Typically, such spiral shape is located on a portion of a string cam corresponding roughly to the integrated tangent contact points, between a drawstring and the string cam, during at least a part of a let-off portion of the draw and generally terminating at, or near, full draw. In certain embodiments, the spiral structure may occupy an arc about the axis of rotation of the string cam that is up to about 150 degrees, or even more in some cases.

A preferred mounting system for a pulley used in rigging of an archery bow includes a bearing assembly having an outside race providing a stub portion sized for press-fit reception inside a pulley bore. The outside race of the bearing assembly carries a flange, or other structure, disposed to form a structural interference with a pulley surface near a perimeter of the bearing bore. The structural interference between a bearing race flange and structure of a pulley body is operable to prevent undesired displacement of the bearing assembly in an inward direction with respect to the pulley.

Embodiments permitting a draw length adjustment typically include a removable tower anchor for anchoring an end of a control cable. The tower anchor spaces a cable anchor location apart from one cam boundary by a distance greater than the thickness of an interposing cam element. Such an anchor desirably is attached to foundation structure, typically provided by a cam element of the control pulley, by a grade 8 or better fastener. The fastener head forms a reinforcing structure operable to resist a tipping moment applied to the tower anchor by the control cable. Preferred fastener heads include flat head, cap head, and countersink styles, preferably also including a socket head feature to tighten the fastener. A base of the tower anchor desirably provides sufficient size to resist the tipping moment.

Resilient elements may be disposed, in certain embodiments of the invention, for contacting rigging members at certain pulley rotations to attenuate vibration. For example, a resilient element desirably is positioned to contact a power cable, creating an interference and forming a positive draw stop. Such a resilient element operates to reduce cable vibration sounding like a "click" as the draw stop is engaged. Additionally, a resilient element may be disposed at a tail end of one or more string cams to contact the drawstring during pulley over-rotation. Such a tail-mounted resilient element may reduce drawstring vibration subsequent to release of an arrow from a drawn position. Suitable resilient elements display vibration dampening or attenuating characteristics. Certain preferred resilient elements are configured to form an interlocking, self-biased, interference with foundation structure provided by a pulley.

BRIEF DESCRIPTION OF THE DRAWINGS

In the drawings, which illustrate what is currently considered to be the best mode for carrying out the invention:

FIG. 10 illustrates cable and drawstring rigging carried on the top and bottom pulley members illustrated in FIG. 1 at a full-draw position.

DETAILED DESCRIPTION OF THE ILLUSTRATED EMBODIMENT(S)

Figure 1:
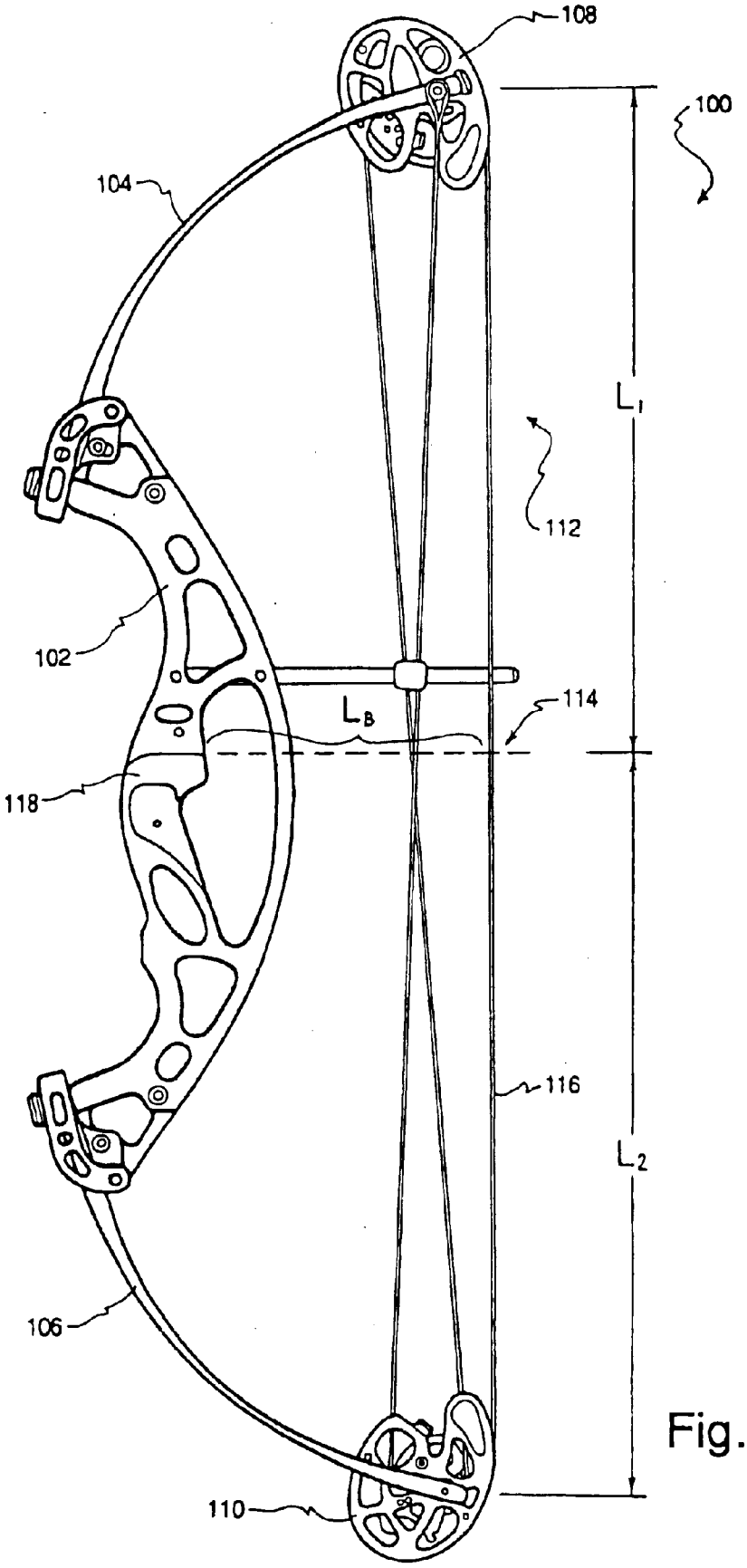
FIG. 1 is a side view of a compound archery bow carrying pulleys according to the invention that are strung with cable rigging and oriented at a brace condition.

As illustrated in FIG. 1, a compound archery bow constructed according to principles of the invention is indicated generally at 100. Bow 100 may be characterized as a modern compound archery bow, and typically includes a handle or riser 102, an upper limb 104, a lower limb 106, an upper pulley member 108, and a lower pulley member 110. For convenience, the specific currently preferred embodiment described below may make reference to a top pulley member 108 being a follower pulley and a bottom pulley member 110 being a control pulley. However, it is possible also to reverse the positions of the control and follower pulley members between top and bottom positions. Cable and bowstring rigging, generally indicated at 112, is entrained about the pulleys 108 and 110, as further described below with reference to other FIGS. that illustrate additional pulley structure.

FIG. 1 illustrates bow 100 at a brace condition; fully assembled with the drawstring under tension caused solely by the bow limbs 104 and 106, respectively. The Bow 100, as illustrated in FIG. 1, is ready to nock an arrow. Limbs 104 and 106 can be any type or configuration of bow limb, including one piece (sometimes called "single" or "solid" limbs), and split (sometimes called "dual" or "multiple" limbs). The attachment of the limbs 104, 106 to the riser 102 is not an important part of this invention. Any attachment operable to secure a limb 104, 106 to a riser is adequate. Limbs 104, 106 merely should be arranged such that they can store energy as an arrow is drawn, and release that stored energy to an arrow subsequent to release of the arrow by an archer.

With continued reference to FIG. 1, the distance between a nocking point, generally indicated at 114, on the drawstring 116 and a reference point on an arrow rest 118 is identified as a brace length $L_B$. For future reference, the length from nocking point 114 to the point at which drawstring 116 is tangent to the upper pulley member is indicated at $L_1$. The length between the nocking point 114 and the point at which drawstring 116 is tangent to the lower pulley member 110 is indicated at $L_2$. $L_1$ and $L_2$ may be the same, or approximately the same length, although in general they are different lengths. The difference between $L_1$ and $L_2$ may be defined as the nocking point offset. It is common for $L_2$ to be larger than $L_1$ by some amount, such as by an inch or two, and by an even larger amount in certain cases.

Figure 2:
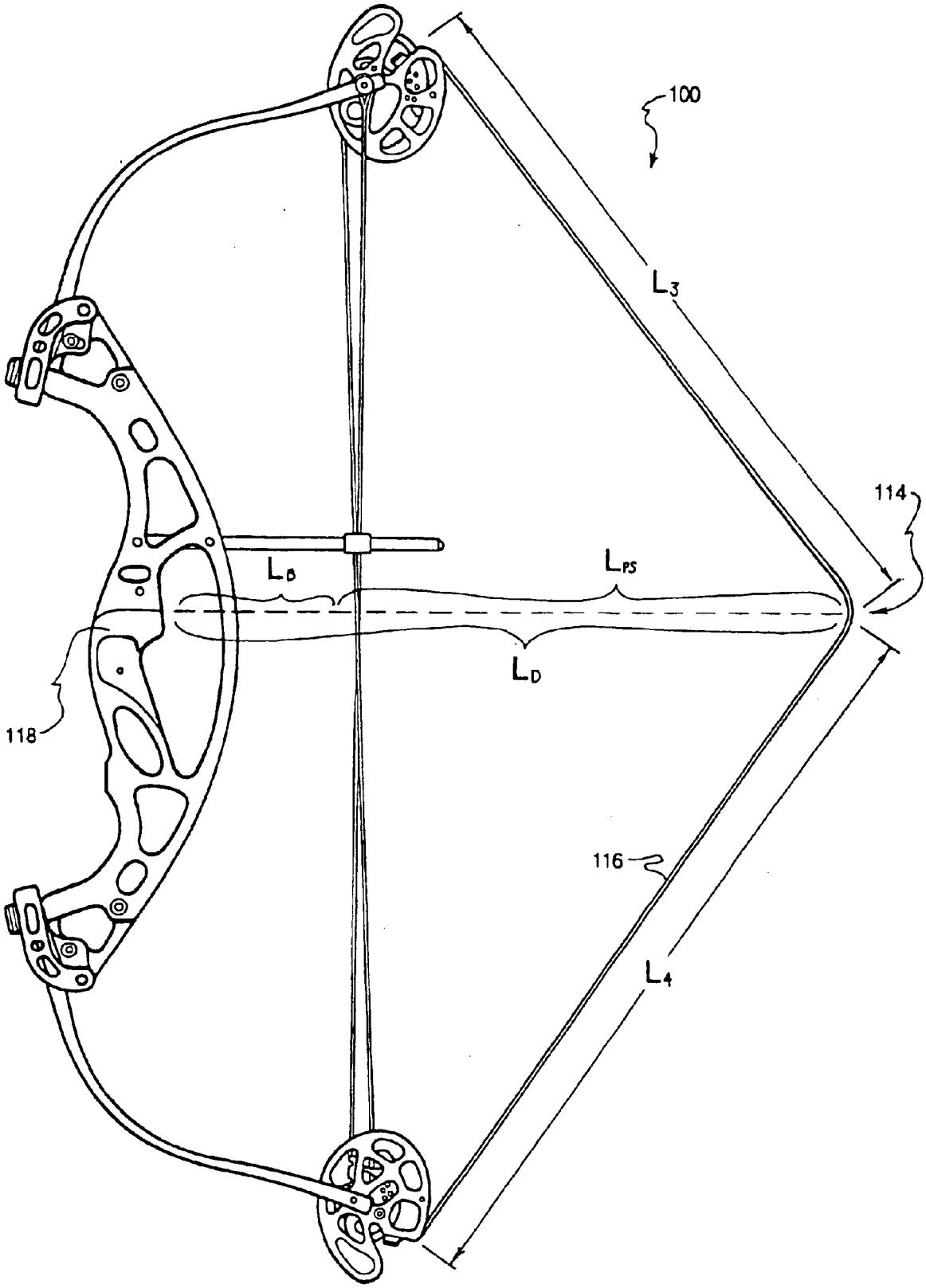
FIG. 2 is a side view of the archery bow of FIG. 1 at a full draw position.

FIG. 2 illustrates bow 100 in its fully drawn condition. Tension in drawstring 116 now has an additional component due to the archer pulling transversely on the nocking point area. The increased distance of nocking point 114 from the arrow rest 118 is indicated as $L_{PS}$, for the power stroke length. The draw length, $L_D$ is the sum of the brace length, $L_B$ and the power stroke length, $L_{PS}$. The length, at full draw, from nocking point 114 to the point at which drawstring 116 is tangent to the upper pulley member is indicated at $L_3$, The length, at full draw, between the nocking point 114 and the point at which drawstring 116 is tangent to the lower pulley member 110 is indicated at $L_4$.

It is desirable for the nocking point 114 to travel in a substantially straight-line path from release at full draw, passing through brace, and until the arrow separates from the drawstring 116, to resist generation of transverse vibration in, and to promote stability of, the released arrow. Uniformity, or similarity with respect to each other, of the limbs 104 and 106, including their lengths and bending stiffness, has an effect on straightness of the nocking point travel path. Typically, limbs are made as similar as possible in stiffness and in length to minimize variables that complicate bow tuning.

For example, different stiffness between top limb 104 and bottom limb 106 causes different deflections of the limb portions holding pulleys 108 and 110. Those different deflections are difficult to track or predict for purpose of bow tuning. Therefore, it usually is desirable to minimize variability between top and bottom limb deflections, and instead, to arrange the pulley members 108, 110 to unwind portions of drawstring 116 at different rates. That is, the change in drawstring length represented by the quantity $(L_3-L_1)$ may be different than the quantity $(L_4-L_2)$. The impact of the different drawstring lengths will be more pronounced on a bow having a tip limb span of 30 inches, compared to a bow with the same amount of nocking point offset, but a 46 inch tip span.

A difference in length of unwrapped drawstring, or cable feed out, will be required between the top and bottom pulleys, assuming similar limb deflections, when $L_1$ is a different length than $L_2$, or else the nocking point 114 unavoidably will depart from a straight-line path. A difference in unwrapped drawstring can be caused by rotating the pulleys at different rates (different pulley timing), or by forming pulleys to have different wrapped arc lengths corresponding to the same pulley angular rotation, or by a combination of both such arrangements.

Figure 3:
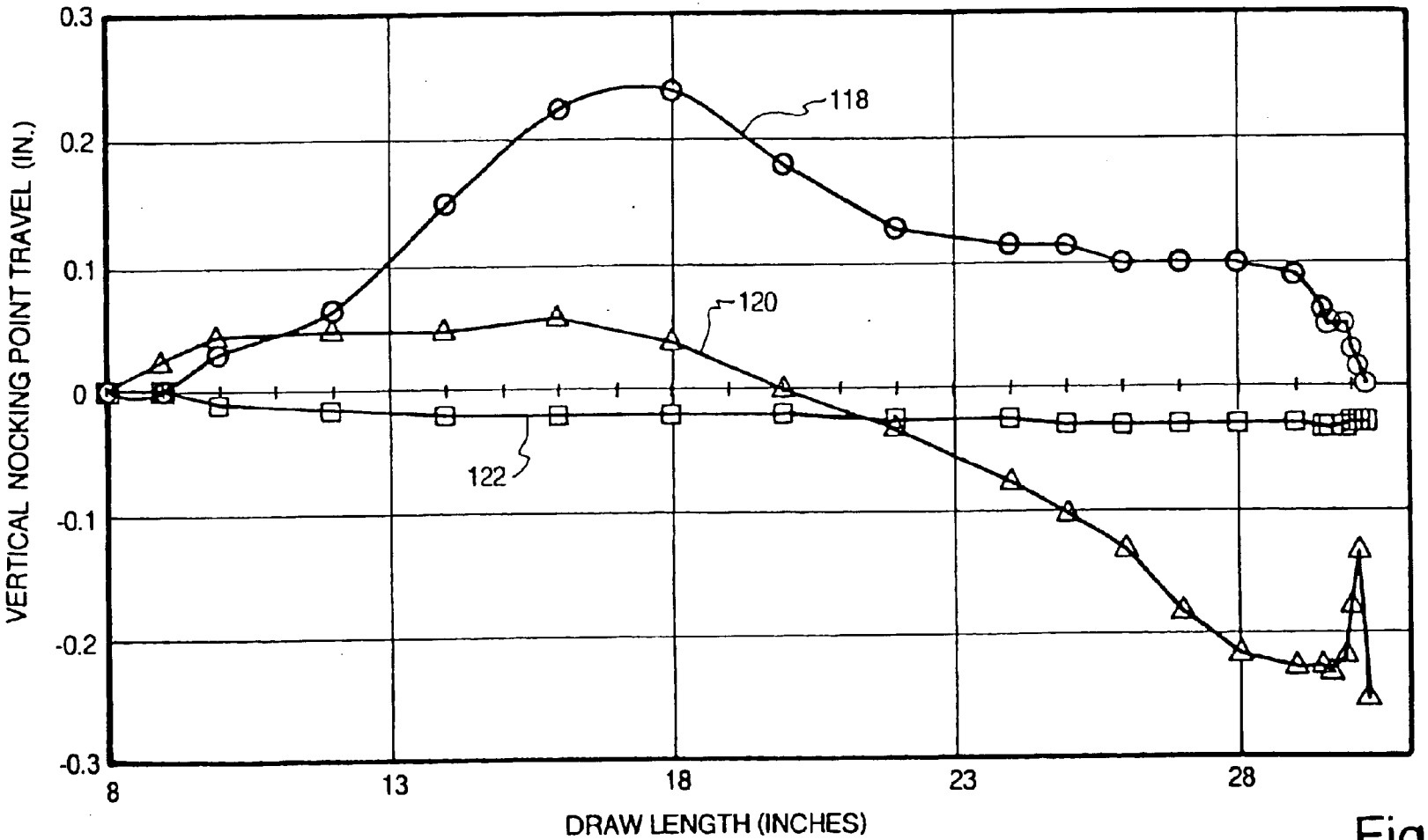
FIG. 3 is a plot illustrating nocking point travel for a variety of bow types and cam timings.

Certain advantages provided by the instant invention can best be illustrated by comparing characteristics provided by the invention to such characteristics inherent in the prior art archery bows. Referring now to FIG. 3, the transverse component of nocking point travel of a commercially available bow of the "single cam" type is indicated by data line 118. As outlined immediately above, timing of the pulley elements affects straightness of travel for nock point 114. Timing between pulley elements is not an issue with "single cam" type bows, because the single timing element cannot loose synchronization with itself. However, a true "single cam" compound archery bow inherently and unavoidably will have undesired transverse nocking point travel. The transverse motion in such a bow is imparted by the single eccentric element which takes up and feeds out cable at changing rates, while a concentric idler pulley wraps and unwraps cable at a constant rate. In certain modified forms, a "single cam" system may be tailored (e.g. by changing the concentric idler wheel to an eccentric), to provide nearly straight-line nocking point travel for a certain draw length. However, such a system typically cannot maintain such straight-line nocking point travel subsequent to making an adjustment to pulley structure operable to change the draw length.

A common problem with bows of the so-called "dual-cam" type, is that the timing of the pulley members carried on opposite limb ends can shift with respect to each other, resulting in out-of-time cams, and attendant nonlinear nock travel. Nonlinear transverse nocking point travel inherent in an out-of-time, commercially available, "dual-cam" type bow is indicated by data line 120 in FIG. 3. Timing of "dual-cam" bows can be corrupted by uneven cable stretch, by an anchor point shift between one or both pulley members and an associated cable, or even torque applied by an archer's hand—perhaps due to the weight distribution of bow accessories, such as an extended and heavy stabilizer.

The nocking point travel typical in one embodiment of the invention is indicated by experimental data plotted in line 122 in FIG. 3. The transverse component of nocking point travel for the invention may easily be tailored, if desired, to depart from the substantially straight path indicated in FIG. 3. The programmed nocking point path will inherently remain substantially the same, regardless of cable stretch, due to the arrangement of cable and drawstring rigging that is discussed more fully below. As will be discussed in more depth below, timing between pulley elements in the invention is dominated by rotation of a single pulley, so the bow rigging system provided by the invention is much more forgiving than a bow having rigging of the "dual cam" type.

Certain embodiments of the invention are structured to change the draw length of a given bow to fit a particular shooter. Such adjustability permits a store to stock a single bow that is adjustable to fit a variety of sizes of customers. Additionally, a customer may grow in size, and adjust his bow to accommodate such growth. When the draw length is changed, it is desired that such change not detrimentally affect the nocking point travel. Certain embodiments of the invention are operable to permit changing the draw length $L_D$ without imposing a deflection in nocking point travel that is transverse to the direction of arrow flight. Preferred embodiments are structured to permit making an adjustment in draw length while the bow, such as bow 100, remains fully strung; with the drawstring under tension.

Figure 4:
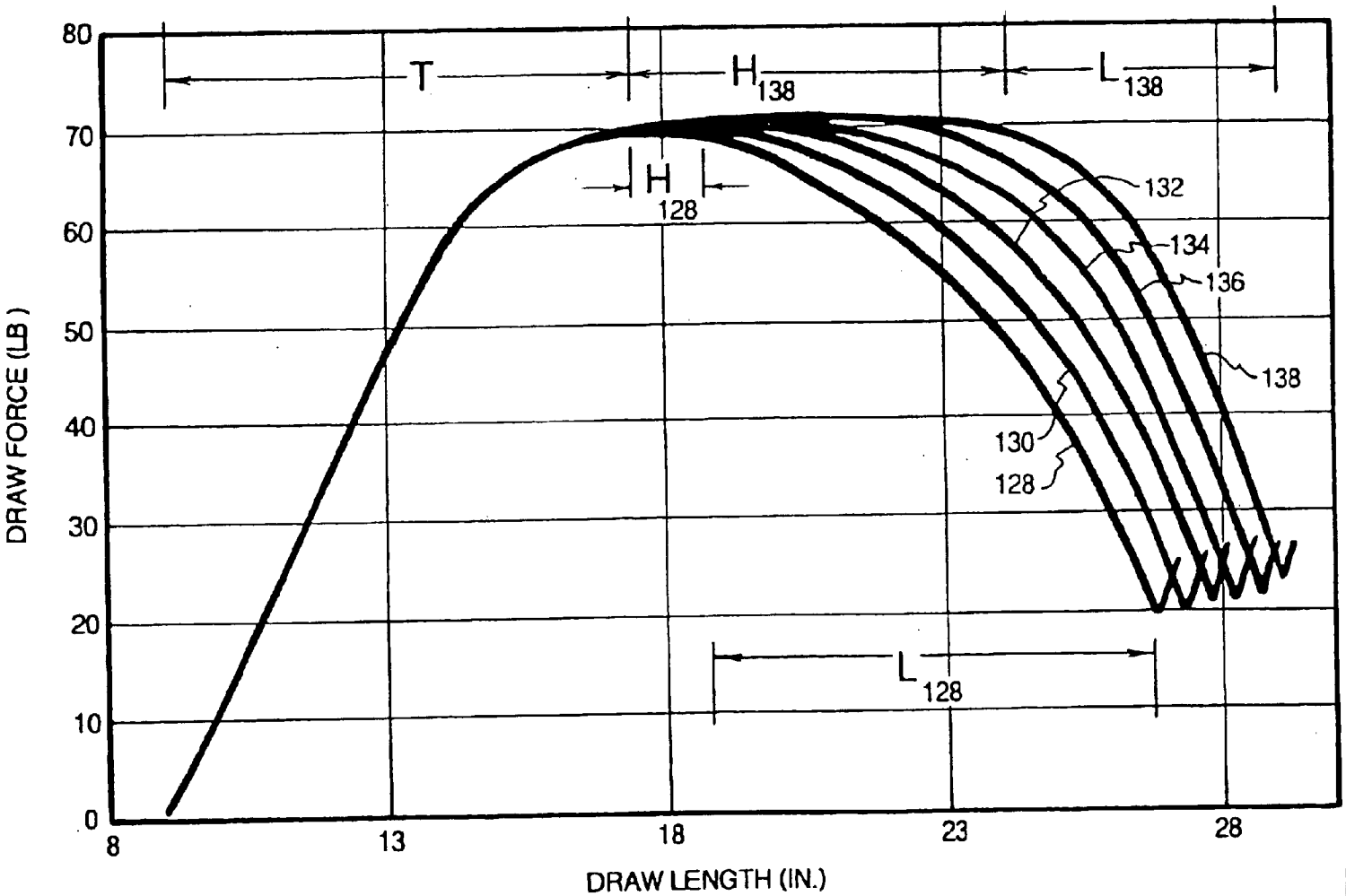
FIG. 4 is a plot of force-draw curves for representative pulley members according to the invention that are arranged to offer different draw lengths.

One characteristic, of certain embodiments of the invention, provides a similar shape to portions of the draw force curve as the draw length is changed. Several plots, 128–138 of draw force vs. draw length corresponding to pulley members according to the invention, adjusted to offer different total draw length, are shown in FIG. 4. Experimentally collected data indicated by plot line 128 are representative of a draw-force plot for a bow having its pulley members adjusted to provide a maximum draw length of about 26½ inches. Data indicated by plot line 138 are representative of the draw-force plot for the same pulley members mounted on the same bow, but adjusted to have an increased maximum draw length of about 29½ inches. The shapes of the initial loading, or force build-up portion, T, and the maximum draw force portions, $H_{128}$ and $H_{138}$, remain similar as the draw length is adjusted. However, the length of the maximum draw force portions, $H_i$ of the various data curves does change as draw length changes. As indicated in FIG. 4, the maximum draw force can have the same peak value for a range of draw lengths. That is, changing the draw length for a given pulley set does not require a change in maximum draw force of the bow on which the pulley set is mounted. The let-off portions, $L_i$, are not necessarily as similar, and generally acquire a different proportional length as draw length is changed.

The data plotted in FIG. 4 is generally representative of certain embodiments of the invention configured to exhibit characteristics of "hard" cams, or pulley members. "Hard"—cams are generally characterized by a rapid take-up and let-off portions in the draw force curve, and typically include a "flat" section of increasing draw length at an approximately constant, or relatively slowly changing, draw force. "Hard" cams generally are capable of providing more stored energy in a bow's limbs as an arrow is drawn. The invention is equally suited for use with "soft" cams, or pulley members. "Soft" cams, or pulley members, are typically characterized as exhibiting more gradual take-up and let-off portions in their force-draw plots, and typically lack any "flat" section in their plots. An eccentrically mounted, substantially round, wheel forms an example of a soft cam.

Figure 5:
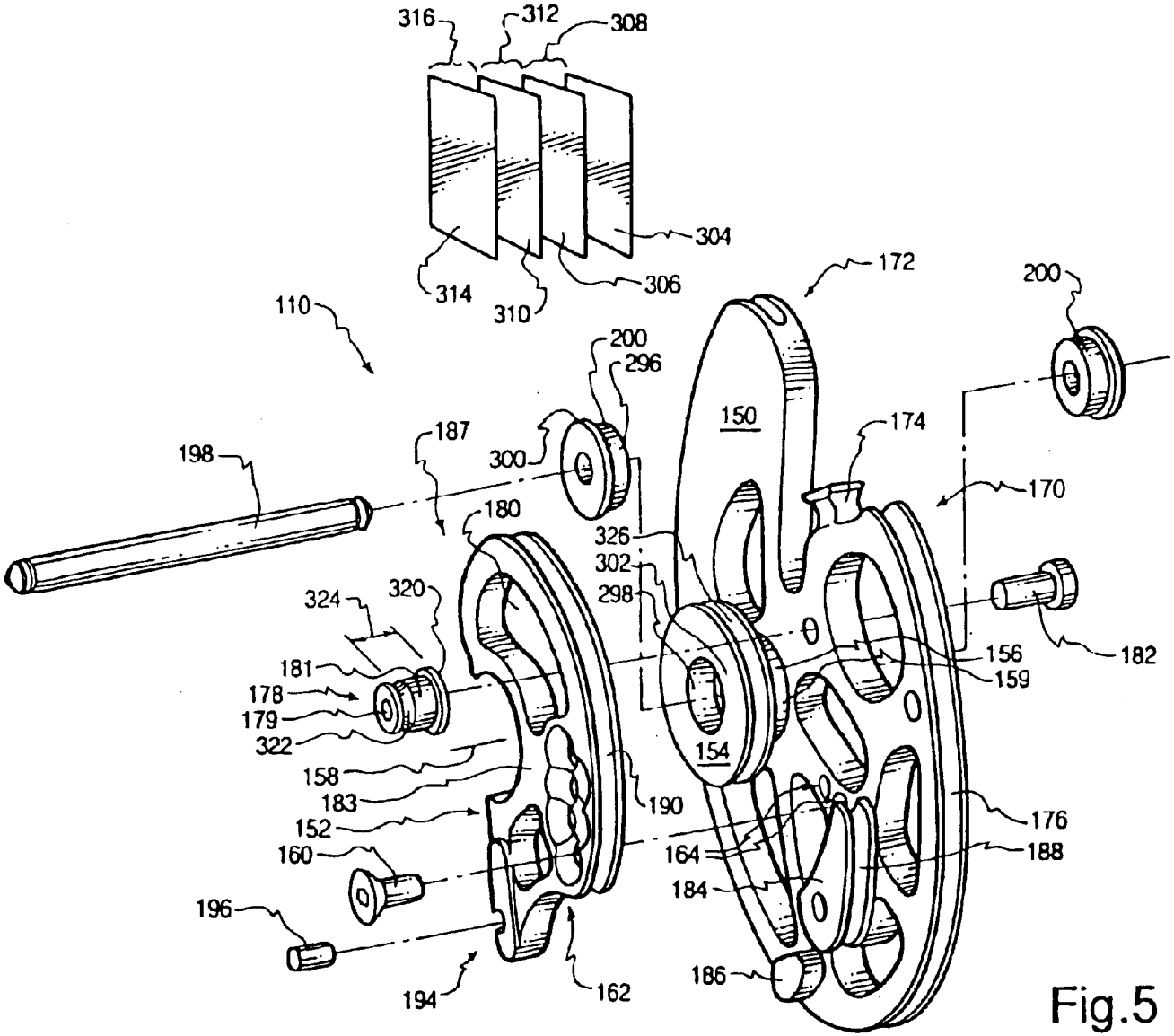
FIG. 5 is an exploded assembly view in perspective of the bottom pulley member in FIG. 1.

FIG. 5 illustrates a currently preferred embodiment of a bottom pulley member 110 in an exploded, assembly perspective looking at the cable side of the pulley 110. Pulley member 110 is deemed a control pulley, because rotation of pulley member 108 is controlled by "slaving" pulley 108 to pulley 110 using a length of rigging cable. Pulley 110 typically includes: a control string cam 150; a power cam, generally indicated at 152; and a timing cam 154. The illustrated power cam 152 fits into registration in a slot 156 located between control string cam 150 and timing cam 154. When assembled, the illustrated three cams included in illustrated control pulley 110 are essentially stacked in substantially parallel planes in close association with each other.

It is currently preferred to form control string cam 150 and timing cam 154 from a contiguous piece of material, such as Aluminum, or certain plastics, to help resist intra-cam deflections. However, it is within contemplation alternatively to form each individual cam as a separate "layer", and stack three such layers together to form the pulley member 110. In a stacked pulley, the separate layers may be joined through use of fasteners, threaded joints, adhesives, press-fits, or alternative joining mechanisms operable to maintain alignment and proximity of the separate components.

Bore 158 through power cam 152 is defined by an arc subtending greater than 180 degrees and is thereby operable to provide a rotational interface with hub structure 159 operable to space timing cam 154 apart from control string cam 150. This rotational interface assists in locating power cam 152 to make adjustments in draw length. A portion of power cam 152 can first be rotated to the desired orientation with respect to control string cam 150. Then, fastener 160 can be installed through one of a plurality of adjustment locations, generally indicated at 162, for reception in control string cam 150 to secure the rotating portion of power cam 152 in that orientation.

As illustrated in FIG. 5, there are six individual countersunk adjustment locations 162 in which a fastener 160 may be inserted to fix the orientation of power cam 152 with respect to the control string cam 150. The individual adjustment locations are arranged in two substantially parallel and arcuate rows. Two cooperating fastener receiving locations are carried on control string cam 150, and are generally indicated at 164. The adjustment locations 162 are arranged in an offset manner to cooperate with receiving locations 164 such that an incremental adjustment of power cam 152 is accomplished by moving fastener 160 between one row and a neighboring, offset, adjustment location in the other row.

Alternative adjusting and fastening arrangements operable to fix the orientation of a power cam 152 with respect to a control string cam 150 are also within contemplation. For example, three rows of adjustment locations 162 may be provided in a power cam 152, and three cooperating receiving locations 164 in a control string cam. Additional rows of adjustment locations 162 and additional cooperating receiving locations 164 can also be provided, if desired for a smaller incremental adjustment, or for an additional range in adjustment. Another alternative arrangement may dispense with bore 158 and alternatively provide a plurality of fasteners 160 with a plurality of adjustment locations 162 and receiving locations 164; all arranged to provide a variety of positions for captured retention of power cam 152. However, providing a fixed rotation axis for the rotating module portion of power cam 152 does greatly simplify making an adjustment in draw length over an alternative having more degrees of freedom in which to move the power cam 152.

Continuing to refer to FIG. 5, the illustrated control string cam 150 has a head, generally indicated at 170, and a tail, generally indicated at 172. A first end of a drawstring (not illustrated) can be attached at (typically is looped about) drawstring anchor 174 illustrated near head 170. The drawstring is received in portions of control string groove 176 located around the perimeter of control string cam 150. As control string cam 150 rotates, the drawstring wraps and unwraps from the groove 176, depending upon the direction of rotation of the control string cam 150.

Still with reference to FIG. 5, assembly of illustrated power cam 152 to a control string cam 150 is facilitated by locking the power cam 152 with respect to its intended position, placing the open portion of bore 158 into encircling engagement with hub structure 159, and then rotating the power cam 152 to engage bore 158 about the hub structure 159. An undercut, or slat (not illustrated), permits the bore 158 to first slide into encircling engagement with the hub structure 159.

After the illustrated power cam 152 is installed in slot 156, a removable tower anchor, generally indicated at 178, can be fastened to control string cam 150. As illustrated, a socket 179 is included in anchor 178 to receive a wrench, such as an Allen wrench to assist in installing tower anchor 178 to its foundation. Anchor 178 generally passes through a void, or aperture, 180 in power cam 152, although other attachment configurations are feasible. Aperture 180 desirably is sized to permit a range of rotation displacement of power cam 152 without interference from anchor 178. It is alternatively within contemplation to provide a wrench flat, or a hexentric cross-section shape, on stem structure 181 of anchor 178 to accommodate a wrench or socket.

One arrangement to fix the anchor 178 to control string cam 150 is embodied in fastener 182. Fastener 182 is received in threaded reception inside anchor 178 to fix anchor 178 relative to a foundation on control string cam 150. Fastener 182 may alternatively be embodied as a socket head cap screw having a head operable as a reinforcing structure to resist a moment applied by control cable 272 to tower anchor 178. An alternative fixing arrangement provides a threaded stub shaft protruding from tower anchor 178. Such a shaft may be formed as an integral part of anchor 178. A protruding threaded stub shaft can be received in threaded reception in control string cam 150, and/or may be received in a separate threaded nut operable as a reinforcing structure to resist a moment applied by control cable 272 to tower anchor 178.

Other fixing arrangements are possible, including press fits, adhesive bonding, and journalled split rings. It is merely desired for the fixing arrangement to resist motion of the anchor 178 relative to the control string cam 150. The fixing arrangement preferably is removable to facilitate installation of, or an exchange of, power cam 152. However, the control cable tower anchor 178 is not required to be removable if the timing cam 154 is removable, or if a passage were cut in the power cam module 183 to allow for installation of the power cam module 183 under the timing cam 154.

Continuing to refer to FIG. 5, an entry ramp 184 portion of a power cam 152 may be arranged as either a removably affixed, or an integral, part of control string cam 150. A rotating portion of power cam 152 may be designated as a power cam module 183. Power cam module 183 may be rotated to increase, or decrease, the effective, or usable, length of the arc distance between the entry ramp 184 and a let-off portion of power cam module 183 generally indicated at 187. A larger arc length corresponds to an increased draw length, and vice-versa. As illustrated, power cam module 183 is adapted to rotate inside an arcuate radius of entry ramp 184 whereby to adjust the draw length of a bow on which the pulley 110 is mounted.

Advantages provided by an immobile entry ramp, such as entry ramp 184, include: the power cam module 183 may be kept relatively small; and the drawstring tension can be maintained relatively high at brace, to resist drawstring over-travel when an arrow is fired from a bow. (Drawstring over-travel is defined as deflection of the drawstring from brace condition towards an archer's bow-holding hand.) The fixed entry ramp 184 of power cam 152 can be oriented and arranged to provide a rapid take-up portion on a draw force vs. draw length plot. Correspondingly, the drawstring tension increases as the pulleys over-rotate, effectively reducing drawstring over-travel. Furthermore, the entry ramp 184 can be positioned to prevent a cable stretch, such as a stretch of a power cable, from contacting the module 183, thereby facilitating adjustment of the module 183 at a brace condition.

The control string cam 150, illustrated in FIG. 5, carries an anchor 186 for a first end of a power cable (not illustrated). A first end of a power cable can be attached to (typically is looped about) anchor 186, and trained about grooves 188 and 190 in the power cam 152.

Both of anchor 186 and fixed entry ramp 184 desirably are manufactured integral with control string cam 150 to increase robustness of the pulley 110. However, it is within contemplation for one, both, or other such components, to be affixed to the control string cam 150, or other component, during assembly of a pulley 110 or 108. There are many suitable fastening arrangements, including threaded fasteners, adhesive joints, press fits, and the like, operable to maintain components in position in a pulley 110, or other pulley 108.

Continuing to refer to FIG. 5, power cam module 183 desirably provides a positive draw stop, generally indicated at 194. Draw stop 194 is arranged to cause a transverse interference with the power cable (not illustrated) at a full-draw position. Illustrated draw stop 194 includes a portion of power cam 152 that may be described as "flat" and provides structure spaced apart from the wrapping contact cable position. This spaced apart structure forms a lever arm adapted to resist further rotation of the control pulley 110 by forming a transverse interference with the power cable.

It is desirable, in certain embodiments, to include a resilient element 196 arranged first to contact the power cable, whereby to dampen sound produced as structure carried by draw stop 194 contacts the power cable. Resilient element 196 may be formed from any suitable attenuating material, including rubber, viscoelastic materials, urethane, and the like. Illustrated resilient element 196 is installed in interlocking foundation structure 197 provided by power cam 152. Typically, a tension load is applied to resilient element 196, during its installation, to cause a reduction in the cross-section received inside structure 197. Upon release of the tension load, a portion of resilient element 196 forms a self-biased, interference fit with cooperating interlocking structure 197, that is operable to maintain resilient element 196 fixed in place on power cam 152.

Pulley 110 can be carried on axle 198 for mounting for rotation at an archery bow limb tip. Rotation of pulley 110 about axle 198 is typically facilitated by interposing a pair of bearings 200 between the pulley 110 and the axle 198. Workable bearings include flanged roller bearings, as illustrated. It is within contemplation that the bearings 200 may be replaced by ball bearings, sleeve elements (not illustrated), or that the pulley itself may form a sleeve element adapted to fit about axle 198.

Figure 6:
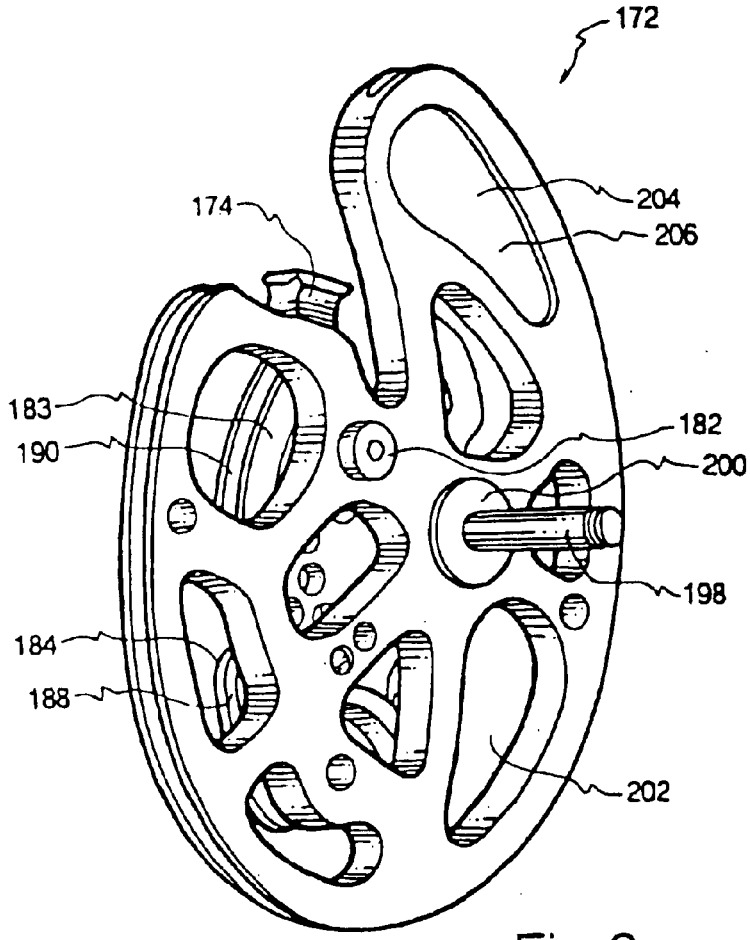
FIG. 6 is a view in perspective of the opposite side of the pulley illustrated in FIG. 5, with the pulley being assembled.

FIG. 6 illustrates an assembled pulley 110, looking at the draw string side. Various apertures, or void spaces, 202 may be included in one or more cam components of a pulley to lighten the pulley and reduce its rotational moment of inertia. Void space 204, carried at tail 172 can be configured to receive a resilient element 206 adapted transversely to contact and dissipate energy from drawstring 116 (FIG. 1) as the pulley 110 over-rotates after release of an arrow. Resilient element 206 may alternatively be configured in harmony with alternatively structured receiving structure, similar to resilient element 196 and its receiving structure 197. Furthermore, a resilient element operable to attenuate vibration in elements of bow string rigging can be integrated into a cam element of a pulley 108 or 110 by way of an overmolding, or other manufacturing process or operation.

Figure 7:
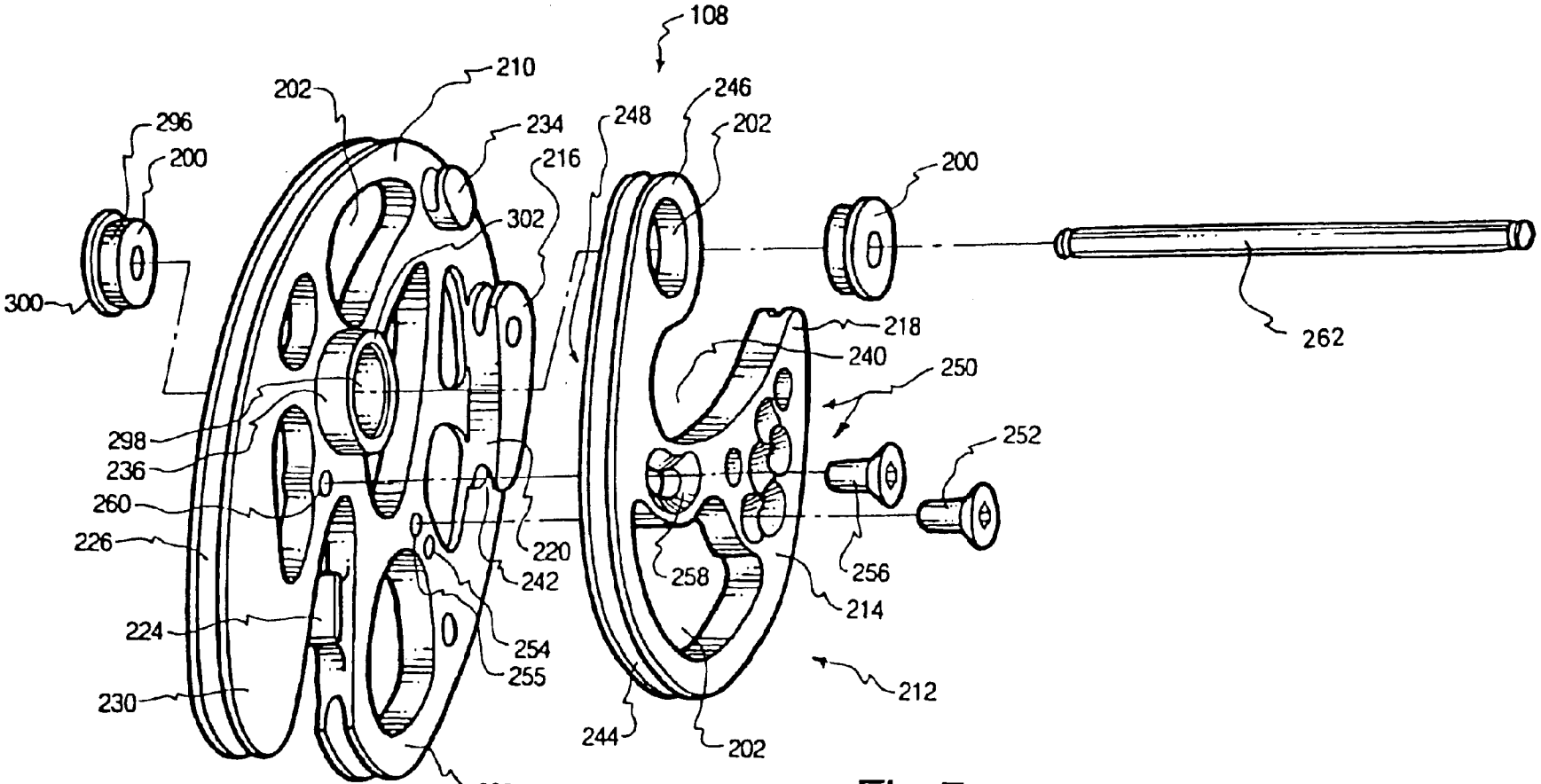
FIG. 7 is an exploded assembly view in perspective of the top pulley member in FIG. 1.

FIG. 7 is an exploded view of follower pulley 108 taken looking at the cable side of the follower pulley 108. Follower pulley 108 typically includes a follower string cam 210, and a follower cam, generally indicated at 212. Certain embodiments of the follower cam 212 may include a rotatable follower cam module 214, and a fixed follower cam entry ramp 216. Module 214 is illustrated with a rotating head portion 218 having a size and shape operable to rotate inside the arc forming surface 220 of fixed entry ramp 216. As with the power cam 152, a fixed entry ramp 216 of follower cam module 214 permits module 214 to be made smaller, and still provide a fixed, steep take-up in draw weight, which helps reduce drawstring over-travel as an arrow is fired. Also, the fixed entry ramp can be arranged to prevent contact between the control cable and the adjustable follower cam module 214, thereby facilitating rotation of the adjustable follower cam module 214 at a brace condition of a bow.

With reference to FIG. 7, a follower string cam 210 typically carries an anchor 224 for the second end of a drawstring (not illustrated). A drawstring is typically fixed to follower string cam 210 by hooking an end loop about anchor 224, and training the drawstring about groove 226 to wrap the follower string cam 210 from its head 228 towards its tail 230. Certain additional components that may be integral with, or otherwise carried by, a follower string cam 210 include: anchor 234 for a second end of the control cable (not illustrated); fixed entry ramp 216 of follower cam 212 (if present); and guide structure, or hub, 236 for convenient orientation of module 214 to make an adjustment in draw length.

While follower cam 212 can be provided as an integral part of follower string cam 210, it is currently preferred to arrange follower cam 212 for rotation with respect to cam 210 to provide for making an adjustment in draw length. A follower cam module 214 typically includes a bore structure 240 adapted to interface with hub 236 and facilitate adjustment of module 214 with respect to follower string cam 210. Bore structure 240 illustrated in FIG. 7 is open sided, to facilitate assembly of follower cam module 214 onto cam 210, and to reduce weight of the assembled follower pulley 108. It is within contemplation for structure 240 to encompass a closed, or other shaped, bore also, including any other cooperating arrangement operable to provide rotational guidance when adjusting draw length.

Still with reference to FIG. 7, a follower cam 212 generally includes a cable groove 242 in fixed entry ramp 216 (if present) and cable groove 244 in follower cam module 214. Grooves such as 242, 216, may be regarded as defining a string track, or cable track, in which to entrain a portion of bow string rigging, such as a cable section or portion of a drawstring. The control cable is trained about follower cam 212 from rotating entry ramp 218 (or fixed entry ramp 216 if present), towards its let-off portion 246 and is received in grooves 242 and 244. The draw length increases as follower cam module 214 is rotated to increase a length of a wrapped arc of the control cable (not illustrated) from fixed entry ramp 216 to let-off portion 246. Draw length increases as module 214 is rotated away from anchor 234, regardless of the presence of a fixed entry ramp 216. A main function of fixed entry ramp 216 is to provide a similar force build-up portion T, regardless of draw length, to the draw force vs. draw length plot, such as those indicated in FIG. 4.

A flat, or somewhat straight portion, generally indicated at 248, may be provided in the edge profile of follower cam 214. Edge portion 248 may operate as a second, or alternative, positive draw stop, functional to resist rotation of pulley 108 beyond full draw by causing a transverse interference between the pulley 108 and the control cable. However, due to the slaved relationship between a pulley 108 and a pulley 110, a hard wall, or positive, stop is achieved by providing a single stop between one of pulleys 108 or 110, and a stretch of a single cable. It is currently preferred to arrange structure carried by the power cam 152 for creating an interference between control pulley 110 and the power cable 270 at full draw.

The rotated position of follower cam module 214 relative to follower string cam 210 can be incrementally fixed by conduits, or adjustment locations, generally indicated at 250. Conduits 250 are illustrated as being arranged in first and second rows in approximately parallel arcs about the axles of associated pulley 108. Individual conduits 250 forming the first and second rows are arranged in a staggered pattern to provide an incremental index between adjacent conduits in one row by an intermediate conduit in the other row. A fastener, or peg, 252 may be inserted through a conduit 252 for reception in one of receiving apertures 254 or 255. Peg 252 therefore can resist rotation between the cams 210 and 214, and also maintain the cams in assembled contact with each other. Typically, peg 252 can be embodied as a threaded fastener received in a threaded bore carried by follower string cam 210. Peg, or fastener, 256 passing through arcuate slot 258 for reception in aperture 260 may be provided, in some embodiments, to assist in maintaining assembly of follower cam module 214 to follower string cam 210.

Similarly to the control pulley 110, follower pulley 108 is carried on an axle 262 for pivoting registration at an end of an archery bow limb tip. As illustrated in FIG. 7, a pair of self-contained bearings 200 may be used to reduce rotational friction of pulley 108. Alternatively, sleeve bushings, or simply material of the pulley 108 may suffice as a rotational interface with axle 262.

Figure 8:
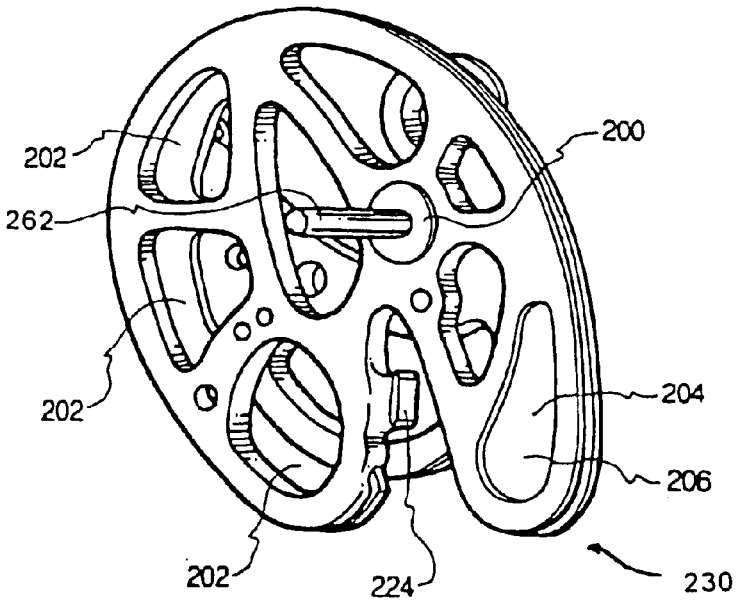
FIG. 8 is a view in perspective of the opposite side of the pulley illustrated in FIG. 7, with the pulley being assembled.

FIG. 8 illustrates an assembled pulley 108, looking at the draw string side. Various apertures, or void spaces, 202 may be included in one or more cam components of a pulley to lighten the pulley and reduce its rotational moment of inertia. Void space 204, carried at tail 230 can be configured to receive a resilient element 206 adapted transversely to contact and dissipate energy from drawstring 116 (FIG. 1) as the pulley 110 over-rotates after release of an arrow.

Figure 9:
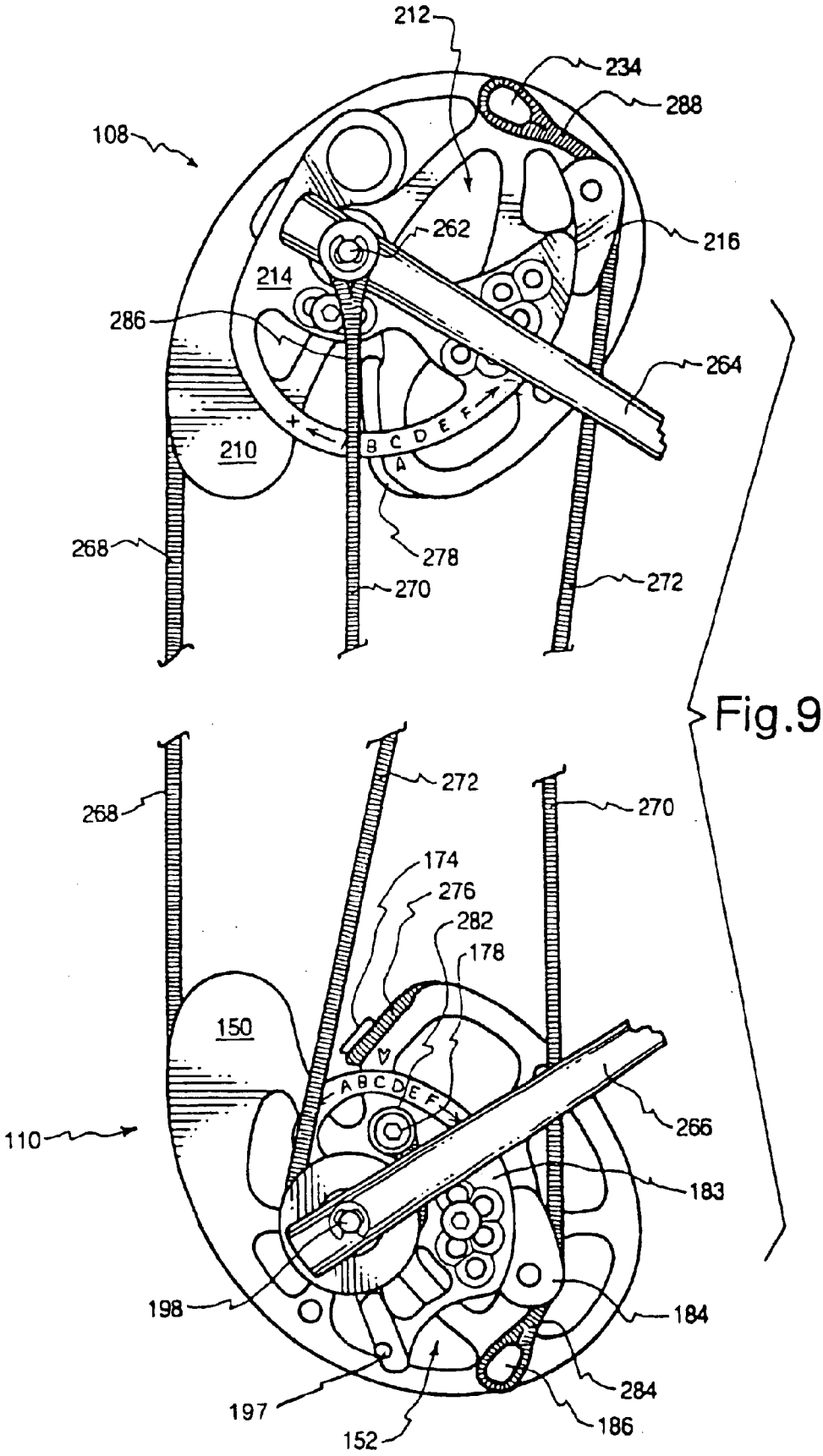
FIG. 9 illustrates cable and drawstring rigging carried on the top and bottom pulley members illustrated in FIG. 1 in a brace condition.

Pulleys 108 and 110 can be mounted for rotation at ends of upper bow limb 264 and lower bow limb 266 in any conventional fashion, one of which is illustrated in FIG. 9. As illustrated, respective pulleys are carried on axles 198, 262 passing transversely through respective limb ends. Also as illustrated, three separate cables are preferably employed in the string rigging of the bow on which pulleys 108 and 110 are mounted. The rigging cables include: a drawstring 268, a power cable 270, and a control cable 272. Of course, it is within contemplation alternatively to reduce the number of cables by combining one or more, and employing a mid-cable anchor arrangement to one or more cam elements. However, use of three separate cables is more simple, robust and permits more easy replacement of cables.

The control pulley 110 anchors a first end 276 of drawstring 268. Anchoring an end of a cable typically involves looping the cable end about an anchor, such as drawstring anchor 174 on control string cam 150. A second end 278 of drawstring 268 is anchored to follower string cam 210 of pulley 108. The actual anchor location for the drawstring 268, and the other cables, is not critical, and can be changed to other workable locations. For example, a workable drawstring anchor location provides for a rotating pulley capable of wrapping and unwrapping the drawstring 268 about the respective string cams 150, 210.

Control pulley 110 also anchors a first end 282 of control cable 272, and first end 284 of power cable 270. A second end 286 of power cable 270 is anchored through a yoke arrangement to opposite sides of axle 262 in upper limb 264. The yoke arrangement forms a "V" shape, with the pulley 108 rotating through the open top part of the "V," and power cable 270 continuing from the bottom, pointed portion of the yoke towards pulley 110. Such a yoke arrangement distributes load from cable 270 equally to each side of the axle 262 to resist application of a limb twisting force. Of course, other arrangements operable to affix an end stretch of a cable to a limb are within contemplation, including all conventional anchoring arrangements. Certain workable arrangements may replace the above described yoke arrangement with structure such as bracketry rotatably affixed to an axle.

Only one limb is used as a reference for pulley rotation relative to the bow on which the pulleys are mounted. Therefore, the present invention may be characterized as employing a single cable reference anchor. The single cable reference anchor is functional to resist rotation of the pulleys 108 and 110 without also requiring corresponding limb flexing of limbs 104 and 106. A single cable reference anchor and rigging that slaves pulley rotation, as employed by the invention, is operable to form a mathematically determinate, stable, pulley system for consistent, repeatable flexing of limbs of a bow, such as bow 100. A second end 288 of control cable 272 is anchored to follower string cam 210 by looping over illustrated anchor 234.

Because of the illustrated anchoring arrangement for the various cables and drawstring, power cam module 183 and follower module 214 are substantially unaffected by tension in any rigging member. Therefore, power cam module 183 and follower module 214 may be rotated to adjust draw length at brace, when the bow is fully strung, and the drawstring is under tension applied by the bow limbs. Therefore, draw length may be adjusted without placing the bow into a bow vice, or even relaxing the limbs using one or more draw weight adjustment bolts. As illustrated in FIG. 10, indicia, generally indicated at 290, may be placed on a module. An indicator, generally indicated at 292, may be placed on a convenient reference surface, such as on a control string cam 150 or follower string cam 210. The indicia 290 and indicator 292 can assist a user to make adjustments in draw length, and help ensure that top pulley 108 and bottom pulley 110 are similarly adjusted to provide the same draw length.

With reference to FIG. 9 and especially to FIG. 10, to make an adjustment in draw length, a user would merely need to rotate the power cam module 183 and the follower module 214 to the desired orientations with respect to their respective string cams. For the power cam module 183, peg 160 is removed from reception in a conduit 162 so that power cam module 183 is free to rotate. The user rotates the module 183 to the desired position for the desired draw length, then inserts peg 160 into reception in the particular conduit 162 that is now in alignment with a receiving aperture (see 164 in FIG. 5) for peg 160. A similar adjustment would be made for the follower module 214 of follower pulley 108.

With reference again to FIG. 10, performance marks, generally indicated at 296, may be applied to a portion of follower pulley 108, such as to follower string cam 210, to indicate, by aligning with reference structure, such as control cable 272 at brace, the bow is in at least approximate tune. A bow limb may alternatively operate as reference structure. Similarly, indicia, generally indicated at 298, may be applied to pulley 110 to align with still other reference structure, such as power cable 270, at brace. Indicia such as 290, 296, 298, and indicator 292, may be painted, drawn, etched, stamped, embossed, or scratched onto a pulley component. Alternatively, the indicia or indicator may be carried on a label or substrate that is applied to a portion of a pulley.

Although the illustrations depict immobile entry ramps 184 and 216 of power cam 152 and follower cam 212 respectively, such fixed entry ramps are not required for the practice of the invention. The fixed entry ramps 184, 216, do provide certain advantages, however. Such fixed entry ramps provide a consistent arc length change versus secant length of unwrapped cable (relative to anchors 186 and 234) to increase drawstring tension as pulleys 108 and 110 rotate past brace subsequent to release of an arrow from a drawn position. Perhaps more importantly, the position and arrangement of fixed entry ramps 184, 216, causes control cable 270 and power cable 272 to move away from axles 198, 262 in a direction toward the riser 102, thereby reducing leverage on the limbs and increasing drawstring tension as pulleys 108 and 110 over-rotate. A change in draw length may be accomplished by rotating modules 183 and 214 without changing the beneficial effect from the fixed entry ramps 184, 216 to reduce drawstring over-travel. Fixed entry ramp 184 also helps to isolate power cam module 183 from transverse contact from power cable 270, permitting more easy rotation of power cam module 183 to adjust draw length. Similarly, fixed entry ramp 216 helps isolate follower cam module 214 from transverse contact from control cable 272 and facilitates rotation of follower module 214.

As shown by comparing FIGS. 9 and 10, the length of control cable 272 wrapped onto follower cam 212 is substantially equal to the length of control cable 272 unwrapped from timing cam 154 plus the length of power cable 270 wrapped onto the power cam 152. As drawstring 268 is pulled back in a draw motion, control pulley 110 is caused to rotate. Follower pulley 108 is then permitted to rotate, being slaved to the rotation of control pulley 110 by control cable 272. Bowstring 268 unwraps evenly from both control pulley 110 and follower pulley 108 to provide substantially straight-line nocking point travel. Relative rotation of both pulleys 108 and 110 with respect to the archery bow is determined by a single reference anchor provided by power cable 270 anchored at an end of bow limb 264. It should be noted that the shape of string cams 150 and 210, and/or modules 183 and 214, can easily be manufactured to provide other than straight-line nocking point travel, should such be desired.

The length and shape of the follower cam groove, or string track (in module 214 plus fixed entry ramp 216, if present), generally is manufactured to provide a wrapped arc length accounting for tangency variations between points of contact of the control cable 272 between the timing cam groove and follower cam groove(s), and similar wrapping contact of the power cable 270 and power cam 152. Such construction can also account for a variable grip below the center of a riser. The timing cam could be eccentric, but then it would be necessary to account for changes in cable wrap with a corresponding change to the follower module to accommodate the change in cable feed out from the additional eccentric. However, in currently preferred embodiments of the invention, an eccentric timing cam inherently causes nocking point departure, between different draw lengths, from a straight-line path.

However, it is within contemplation for an eccentric timing cam to be provided, in certain embodiments, that is fixed to rotate with a power cam 152, or power cam module 183 as draw length is adjusted. Such a timing cam (not illustrated) may be affixed to a power cam, such as power cam 152 at one of a plurality of orientations, if desired to provide additional adjustability. In such an arrangement, a change in draw length may be accomplished without an attendant departure of nocking point travel from a straight-line path.

FIG. 10 illustrates the arrangement of structure in the present invention operable to provide a forgiveness, or tolerance in timing, of the pulleys 108 and 110. In a drawn orientation, power cable 270 essentially lays on top of axle 198. A small additional take-up of cable power cable 270 onto power cam 152 at full draw requires a relatively substantial rotation of pulley 110 due to the small lever arm between axle 198 and power cable 270. In contrast, the follower cam 212 spaces the control cable 272 relatively farther apart from axle 262 at full draw compared to the spacing between power cable 270 and axle 198. Because the pulleys 108 and 110 are slaved together rotationally through control cable 272, rotation of the pulleys is dominated by the orientation of control pulley 110. The rigging arrangement provides a built-in synchronization between the control pulley 110 and follower pulley 108. The power cam 152 and follower cam 212 provide the symmetry benefit of a "dual cam" arrangement.

Furthermore, timing of the pulleys 108, 110 mounted on a rigged bow 100 is significantly more forgiving than if both power cable 270 and control cable 272 approached axles of the respective control pulley 110 and follower pulley 108 by an equal distance. One effect of timing cam 154 is that it establishes a radial spacing between control cable 272 from both of axles 198 and 262. When timing cam 154 is concentric, the minimum spacing of control cable 272 to an axle occurs at axle 198. The spacing of control cable 272 from axle 262 typically also includes an additional component to account for the radial spacing of power cable 270 from axle 198. The inherent radial spacing of the control cable 272 from respective axles 198, 262 provides a lever arm effective to enforce similar rotations between pulleys 108 and 110.

In one currently preferred embodiment of the invention, the minimum radial spacing of a control cable 272 from a centerline of axle 198 is about 0.5 inches, and is a substantially constant value for all rotations of the control pulley 110. In a mating pulley 108, the minimum radial spacing of control cable 272 from a centerline of axle 262 is about 0.675 inches, and occurs at, or near, full draw.

In practical embodiments of archery bows, a minimum radial spacing, or lever arm, of about 0.5 inches between a cable and an axle provides a sufficient lever arm to ensure similar rotation of pulleys 108, 110 (maintain pulley timing). While a smaller radial spacing, or cable offset, is workable, a cable offset that is too small may not sufficiently dominate displacement of the respective pulleys compared to a displacement caused by factors such as cable stretch under cable loading. Since rotation of the control pulley 110 is referenced to a limb by a cable reference anchor, stretch in control cable 272 can permit an undesired, and unequal, rotation of the follower pulley 108 compared to the control pulley 110. A sufficient radial offset of the control cable 272 from rotational axes 198, 262 enforces a pulley synchronizing displacement on the pulley rigging system that typically is orders of magnitude larger than a cable stretch displacement.

The very small radial offset of power cable 270 from the axle 198 provides the large let-off typically associated with a "single cam" arrangement. The power cable 270 illustrated in FIG. 10 is essentially laying on top of axle 198, and therefore has a radial offset equal to the sum of (the radius of axle 198) plus (the radius of the power cable 270). For an axle of 0.2 inches in diameter, and a cable of 0.15 inches in diameter, the radial offset of power cable 270 from a centerline of axle 198 is about 0.175 inches.

Follower pulley 108 also permits control cable 272 to approach the axle 262 on which pulley 108 is mounted to additionally contribute to the let-off in draw weight at full draw. The large let-off in draw weight at full draw obtainable from the cable routing arrangement provided by the invention permits use of string cams 150 and 210 that are shaped to offer improved performance.

It is currently preferred to use control string cams 150 and follower string cams 210 that have substantially the same shape. The respective string cams are typically scaled to account for nocking point offset while holding rotation rate of the string cams equal. That is, given a control string cam 150 of a certain size, the matching follower string cam 210 is generally scaled from the control string cam 150 to unwrap drawstring 116 at a faster or slower rate, but at substantially the same angular rotation, compared to the control string cam 150. A larger string cam will have a higher rate of drawstring feed-out for a given angular rotation of the string cam, and vice-versa. In the case of a nocking point located at the midpoint of a drawstring 116 (nocking point offset is zero), both string cams would typically be the same size. The difference in drawstring feed-out rate between matched string cams typically is set to provide substantially straight-line nocking point travel.

Pulleys 108, 110, or components forming the respective pulleys, may be scaled in size to change draw length in a fixed draw length embodiment of a pulley. When a pulley 108, 110 is scaled for draw length, virtually the entire pulley, including the string cam, and the power cam 152 or follower cam 212, are scaled to achieve the next size. It is sometimes preferable to scale the pulley components because it helps maintain lever arm ratios which in turn preserve the shape of the force draw curve. The timing cam 154 can be scaled independently of the power cam 152. A larger timing cam 154 causes harder wall feel provided by the positive draw stop, and transfers more timing control to the control pulley 110. Of course, the length of the follower groove 224 must reflect any modification to the size/shape of the timing cam 154 carried on the control pulley 110.

In certain cases, such as to match a pair of pulleys 108, 110, to a particular bow 100, the follower cam string profile can include an arcuate portion having an extra expansion or contraction to fine tune nocking point travel. Such a departure from the mating control string cam may occur over roughly 150 degrees of the cam and the quantity of expansion may be varied depending on requirements of the particular bow. Such departure from similar geometry between string cams is not a necessary feature, but can be utilized to improve the shooting characteristics of the pulley set 108 and 110.

As illustrated in FIG. 10, one string cam profile that may be applied to a string cam 150, 210, due to the improved let-off provided by the invention, incorporates a drawstring groove 226 (see also FIG. 7) with a string support surface having characteristics defined by spiral geometry. One embodiment of a string cam 108 with a drawstring track portion defining such a true spiral profile is illustrated in FIG. 10. The arc 294 in which such spiral geometry desirably is located can be as large as about 150 degrees, or more in certain cases. Arc 294 corresponds roughly with a let-off portion of pulley rotation. The spiral shape provides an increasing radius at which the drawstring 268 is supported apart from the axle 262 as the pulley 108 rotates from full draw toward brace. It is currently preferred to orient the spiral portion of the string cams 150, 210, for a theoretical construction origin of the spiral to be centered at an axis of rotation of the corresponding pulley 110, 108.

With reference again to FIGS. 5 and 7, a currently preferred pulley mounting arrangement includes flanged bearings 200. Commercially available bearings 200 suitable for use in such archery application include bearings available under part No. FR3-2RS manufactured in Chengou City, People's Republic of China and imported by RBI Bearing. The specific bearing typically used to mount a pulley 108, 110 is part No. FR3-2RS/C3-B. Such bearings are also available from Impact Bearing of Monrovia, Calif. A stub shaft 296 of bearing assembly 200 is typically received in bore 298 of a pulley 110, 108 in a press fit arrangement. Interference structure carried by bearing 200, such as illustrated flange 300, abuts pulley surface structure 302 located at a perimeter of the bore 298, and resists further travel of bearing 200 in a direction inward to the pulley 110, 108. In certain cases, the abutting structure 302 may be disposed in a counterbore to provide additional clearance for mounting a pulley between narrow mounting structure at a limb tip.

With continued reference to FIG. 5, a removable tower anchor 178 can be characterized with reference to planes defining boundaries of the cam elements forming an assembled pulley 110. Reference planes 304 and 306 are offset by a space 308 and may be considered as surface boundaries of string cam 150. Planes 310 and 306 are offset by a space 312 corresponding to a height of hub 159 and between which planes power module 183 is received. Planes 310 and 314 are offset by a space 316 in which timing cam 154 is received in an assembled pulley 110. Removable tower anchor 178 has a base 320 adapted for abutting onto a foundation structure, typically provided by string cam 150. A center of cable groove 322 is spaced apart from base 320 by a length 324. Length 324 is greater than a corresponding length of space 312, and is operable to space control cable 272 apart from reference plane 306 for reception of a wrapped portion of cable 272 in string groove 326 carried by timing cam 154. Therefore, tower anchor 178 may be characterized as providing cable anchor structure 322 spaced apart from a foundation structure (generally in plane 304), by at least the width of an intervening cam element 183.

Modern archery cam elements typically have a thickness, corresponding to a space 308, 312, or 316, of about 0.1875 inches, although thinner cams elements are possible. Therefore, a reasonable minimum length 324 (between a plane 306 and a center of groove 322) for a tower anchor 178 might be about 0.2 inches. In the currently preferred and illustrated embodiment of a tower anchor 178 in FIG. 5, length 324 is about 0.26 inches. Of course, the length 324 may be larger to space a cable anchor groove 322 apart from a foundation structure 306 by more than one intervening cam element.

Base 320 of tower anchor 178 desirably has a size and shape operable to resist the tipping moment generated by an anchored control cable 272 (not illustrated). Illustrated base 320 has a diameter of about 0.4 inches. A base having a diameter of about 0.35 inches is also workable. A base having a diameter as small as 0.25 inches can also be operational in certain embodiments of archery bows having sufficiently low cable loads. Other shapes for a base 320, or stem 181, are within contemplation, including square and hexagonal. The latter shapes can also permit purchase for a tool operable to tighten a fastening arrangement for tower 178.

Cable loads on a tower anchor 178 may cause bending loads of considerable magnitude, particularly due to the extended moment arm inherent in the offset length 324. Cable loads may increase dramatically during an accidental dry firing of a bow. Therefore, it is currently preferred to sandwich foundation structure of string cam 150 between base 320 and a surface of a head of fastener 182 to distribute the moment induced loading. Fastener 182 preferably is a fastener of at least grade 8 quality to provide satisfactory durability. Furthermore, it is preferred for fastener 182 to have a flat head socket head, although other head shapes, such as cap head and countersink heads, are workable in certain situations. Sometimes, a counterbore (not illustrated) is provided on the drawstring side of string cam 150 to reduce the length of fastener 182 protruding above plane 304 to permit installation of a pulley 110 between narrow supports at a limb tip 266 (see FIG. 9).

Tower anchor 178 currently is manufactured from a stainless steel, although it is within contemplation alternatively to manufacture anchor 178 from brass, or Aluminum. An alternative mounting arrangement includes providing a shaft protruding from base 320 for threaded reception in a nut operable to provide reinforcing structure on an opposite side of string cam 150. The shaft can be threaded into tower 178, or formed as an integral part of the tower 178. Again, a counterbore may be provided in the drawstring side of string cam 150 to receive the nut. Flats may further be formed in the counterbore to assist in tightening the nut onto the shaft.

What is claimed is:

1. A pair of pulley members for use in the bow string rigging of a compound archery bow, the pair comprising:

a control pulley adapted to rotate about a first axle, said control pulley comprising;

a control string cam defining a control string groove operable to wrap and unwrap a first end portion of a drawstring for said bow, said control cam carrying:

a first anchor for a first end of said drawstring;

a second anchor for a first end of a power cable; and a third anchor for a first end of a control cable;

a power cam defining a power cable groove, in a plane approximately parallel to a first plane containing said control string groove and operable to space said power cable away from said first axle by a variable radius; and a timing cam defining a timing groove, in a plane approximately parallel to said first plane and operable to space said control cable apart from said first axle; and a follower pulley adapted to rotate about a second axle, said follower pulley comprising:

a follower string cam defining a follower string groove operable to wrap and unwrap a second end portion of said drawstring, said follower cam carrying:

a first anchor for a second end of said drawstring; and a second anchor for a second end of said control cable;

a follower cam defining a control cable groove, in a plane approximately parallel to a plane containing said follower string groove and operable to space said control cable apart from said second axle by a variable radius.

2. The pulley members of claim 1, wherein:

said power cam comprises a power cam module, said power cam module being movable, with respect to said control string cam and fixable with respect to said control string cam at a plurality of orientations, whereby to effect an adjustment in draw length; and said follower cam comprises a follower cam module, said follower cam module being movable, with respect to said follower string cam and fixable to said follower string cam at a plurality of orientations, whereby to effect an adjustment in draw length.

3. The pulley members of claim 2, wherein:

said power cam module is configured and arranged to be rotatable about said first axle; and said follower cam module is configured and arranged to be rotatable about said second axle.

4. The pulley members of claim 2, wherein:

an entry ramp portion of said power cam is fixed to said control string cam in an arrangement configured to unwrap an arc portion of power cable, said arc portion having a length greater than a secant corresponding to equal cam rotation, operable to reduce tension in said power cable and to effect an increase in drawstring tension, as said control pulley rotates beyond a brace condition subsequent to release of an arrow, thereby to reduce drawstring over-travel; and an entry ramp portion of said control cam is fixed to said follower string cam in an arrangement configured to unwrap an arc portion of control cable operable to reduce tension in said control cable and to effect an increase in drawstring tension, as said follower pulley rotates beyond a brace condition subsequent to release of an arrow, thereby to reduce drawstring over-travel.

5. The pulley members of claim 2, wherein:

said timing groove is concentric about said first axle, whereby to avoid a departure in nocking point travel, from a substantially straight line, due to moving a said module to effect a change in draw length.

6. The pulley members of claim 2, wherein:

said timing groove is disposed concentrically about said first axle, whereby to avoid a change in timing of the respective pulleys to each other due to a change in draw length.

7. The pulley members of claim 2, wherein:

said power cam module and said follower cam module can be adjusted with respect to their associated string cams while a bow on which said pulleys are mounted is strung and the drawstring is under tension.

8. The pulley members of claim 2, wherein:

said anchors carried on said control string cam and on said follower string cam for said cables and said drawstring are configured and arranged such that the respective string pulleys are in rotational equilibrium independent from a force from respective power or follower modules while a bow upon which said pulleys are mounted is strung and the drawstring is under tension.

9. The pulley members of claim 2, wherein:

anchoring structure for said power cam and said follower cam is configured such that an adjustment of draw length is effected in discrete increments.

10. The pulley members of claim 9, wherein:

fixed orientations, of said power cam module with respect to said control string cam, and of said follower cam module with respect to said follower string cam, are determined by registration of one of a plurality of conduits, through a said module, with an anchoring peg.

11. The pulley members of claim 10, wherein:

said conduits are arranged in first and second rows as approximately parallel arcs about the axles of their associated pulleys, and conduits of said first and second rows are arranged in a staggered pattern to provide an incremental index between adjacent conduits in one row by an intermediate conduit in the other row.

12. The pulley members of claim 11, wherein:

said anchor peg comprises a fastener piercing a conduit in a said module for threaded reception in an associated string cam.

13. The pulley members of claim 2, wherein:

the shape of the control cable groove carried on said follower cam is defined, at least in part, by an arc length required to wrap, during a rotation of said follower pulley corresponding to a given rotation of said control pulley, a length of control cable equal to the length of the sum of both: the length of power cable wrapped onto said power cam and the length of control cable unwrapped from said timing cam.

14. The pulley members of claim 2, wherein:
said third anchor is removably retained on said control string cam.

15. The pulley members of claim 14, wherein:
said third anchor comprises torque structure adapted to interface with a tool whereby rotatably to attach said third anchor to said control string cam.

16. The pulley members of claim 15, wherein:
said torque structure comprises a socket structured to receive a torque transmitting tool.

17. The pulley members of claim 1, wherein, throughout a draw motion:
said follower cam is configured to space said control cable apart from said second axle by a radius approximately equal to the sum of (the length of the spacing of said control cable apart from said first axle caused by said timing cam) and (the length of the spacing of said power cable apart from said first axle caused by said power cam).

18. The pulley members of claim 1, wherein:
performance marks are carried on one or more pulley members, said performance marks being configured and arranged for visual alignment to reference structure.

19. The pulley members of claim 1, further comprising:
a positive draw stop carried on a pulley and arranged to cause a transverse interference with a cable stretch of said rigging.

20. The pulley members of claim 1, further comprising:
a resilient member affixed to at least one of said pulley members by way of an interference fit between structure of said resilient member and structure of said at least one pulley member, a portion of said resilient member being structured and arranged to contact said cable whereby to attenuate vibration associated with said interference.

21. The pulley members of claim 20, wherein:
said stop structure is carried on said power cam, and is arranged to cause a transverse interference with said power cable.

22. The pulley members of claim 21, further comprising:
a second draw stop carried on said follower pulley.

23. The pulley members of claim 1, wherein:
said string cams each comprise a spiral groove shape, and are substantially symmetrically in scale with each other to compensate for nocking point offset and to promote straight-line nocking point travel for a discharged arrow.

24. The pulley members of claim 1, further comprising:
dampening structure disposed to contact said drawstring subsequent to an over-rotation of said pulley members from a drawn position beyond a brace condition subsequent to release of an arrow from a drawn position.

25. The pulley members of claim 24, wherein:
said damping structure comprises a resilient element carried on one or more of said string cams.

26. In a compound archery bow of the type providing a positive draw stop by causing a transverse interference between a tensioned cable portion of bow string rigging and stop structure carried on a pulley of the rigging when a full draw position is attained by an archer, the improvement comprising:

including in said stop structure a resilient element having structure forming an interlocking attachment to structure of said pulley, said resilient element being disposed to contact said cable whereby to reduce noise created when causing said interference.

27. The improvement of claim 26, wherein:
said transverse interference is caused by contact between said stop structure and said cable.

28. The improvement of claim 27, wherein:
said stop structure comprises structure spaced apart from said point along a line perpendicular to a radius between said point and an axis of said pulley.

29. The improvement of claim 26, wherein:
said cable makes tangential contact at a proximal end with said pulley at a point along a curve defined by a cable groove that is substantially perpendicular to a radius between an axis of said pulley and said point; and
said stop structure is arranged to contact said cable, at a location that is spaced apart distally along said cable from said point, as said pulley is rotated to a full draw position.

30. The improvement of claim 29, wherein:
said cable is a power cable portion said rigging.

31. The improvement of claim 29, wherein:
said stop structure comprises a flat portion of said curve.

32. The improvement of claim 29, wherein:
said stop structure comprises a discontinuity in said curve.

33. The improvement according to claim 26, said draw stop comprising:
a first interference between first stop structure, carried on a first pulley, and a first cable portion of said rigging; and
a second interference between second stop structure, carried on a second pulley, and a second cable portion of said rigging.

34. A pulley adapted for use in an archery bow, comprising:
at least first, second, and third cam elements having first, second, and third string tracks disposed in approximately parallel, consecutively stacked alignment, said string tracks receiving rigging elements in an entrained configuration;
a rigging tower anchor configured for removable attachment to said first cam element and operable to anchor a rigging element entrained in a string track that is spaced apart from said first cam element by at least a width of one interposing cam; and
a fastener adapted to affix said tower anchor to said first cam.

35. The pulley of claim 34, wherein:
said interposing cam provides an aperture in which to provide a clearance for said tower anchor to accommodate relative motion between said tower anchor and said interposing cam as said interposing cam is adjusted with respect to a reference structure.

36. The pulley of claim 34, wherein:
said fastener provides reinforcing structure disposed on an opposite side of mounting foundation structure from said tower anchor whereby to sandwich said foundation structure between said reinforcing structure and a base of said tower anchor, said reinforcing structure being operable to resist a tipping moment applied on said tower anchor by said rigging member.

37. The pulley of claim 36, wherein:
said fastener comprises a grade 8 or better flat head socket head screw.

38. The pulley of claim 36, wherein:
said reinforcing structure of said fastener is received in a counterbore disposed on said opposite side whereby to maintain a clearance for pulley rotation between portions of a bow limb tip.

39. The pulley of claim 36, wherein:
said fastener comprises a threaded shaft protruding from a base of said tower anchor and received in reinforcing structure comprising a threaded nut disposed on an opposite side of said foundation structure.

40. The pulley of claim 39, wherein:
said threaded shaft is integral with said tower anchor.

41. The pulley of claim 34, wherein:
a tower height from a tower base to a center of an anchor string groove is greater than about 0.2 inches.

42. A compound archery bow, comprising:

a first pulley assembly having a first rotation axis, the first pulley assembly comprising:

a first eccentric cam having a first drawstring groove receptive of a first portion of a drawstring;

a second eccentric cam having a first power cable groove receptive of a first portion of a power cable;

a third concentric, substantially circular cam having a first control cable groove receptive of a portion of a control cable;

a second pulley assembly having a second rotation axis, the second pulley assembly comprising:

a fourth eccentric cam having a second drawstring groove receptive of a second portion of the drawstring;

a fifth eccentric cam having a second control cable groove receptive of a second portion of the control cable;

wherein:

a first length of the power cable is defined by a segment of the first power cable groove in which the power cable is entrained during a draw cycle;

a first length of the control cable is defined by a segment of the first control cable groove in which the control cable is entrained during the draw cycle;

a second length of the control cable is defined by a segment of the second control cable groove in the control cable is entrained during a draw cycle;

wherein a sum of the first length of the power cable and the first length of the control cable is substantially equal to the second length of the control cable.

43. A compound archery bow according to claim 42 wherein the first and fourth eccentric cams are substantially identically shaped.

44. A compound archery bow according to claim 42 wherein the second eccentric cam comprises a resilient element disposed therein and configured to contact the power cable at full draw.

45. A compound archery bow according to claim 44 wherein the first and fourth eccentric cams comprise outermost cams and are substantially identically shaped.

46. A compound archery bow according to claim 42, further comprising a bearing assembly disposed at each of the first and second rotation axes, the bearing assembly comprising:

an outside race having a stub portion sized for press-fit reception into first and second bores, respectively, at the first and second rotation axes, and a ridge sized larger than the first and second bores to limit insertion of the outside race therein.

47. A compound archery bow, comprising:

a first pulley assembly having a first rotation axis, the first pulley assembly comprising:

a first eccentric cam having a first drawstring groove receptive of a first portion of a drawstring;

a second eccentric cam having a first power cable groove receptive of a first portion of a power cable;

a third concentric, substantially circular cam having a first control cable groove receptive of a portion of a control cable;

a second pulley assembly having a second rotation axis, the second pulley assembly comprising:

a fourth eccentric cam having a second drawstring groove receptive of a second portion of the drawstring;

a fifth eccentric cam having a second control cable groove receptive of a second portion of the control cable;

wherein as the drawstring is pulled to a full draw, a sum of:

a first path length of the first power cable groove traversed by the power cable; and a first path length of the first control cable groove traversed by control cable; substantially equals a second path length of the second control cable groove traversed by the control cable.

* * * * *